US010939729B2

(12) United States Patent
Tamm et al.

(10) Patent No.: US 10,939,729 B2
(45) Date of Patent: Mar. 9, 2021

(54) KNITTED SHOE UPPER

(71) Applicant: adidas AG, Herzogenaurach (DE)

(72) Inventors: Stefan Tamm, Herzogenenaurach (DE); Carl Arnese, Herzogenaurach (DE); James Carnes, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 14/257,668

(22) Filed: Apr. 21, 2014

(65) Prior Publication Data

US 2014/0310984 A1 Oct. 23, 2014

(30) Foreign Application Priority Data

Apr. 19, 2013 (DE) ..... 102013207155.8

(51) Int. Cl.

| | |
|---|---|
| ***A43B 23/02*** | (2006.01) |
| ***A43B 1/04*** | (2006.01) |
| ***D04B 1/10*** | (2006.01) |
| ***A43B 1/00*** | (2006.01) |

(52) U.S. Cl.

CPC ..... *A43B 23/0245* (2013.01); *A43B 1/00* (2013.01); *A43B 1/04* (2013.01); *A43B 23/0205* (2013.01); *A43B 23/027* (2013.01); *A43B 23/0275* (2013.01); *D04B 1/102* (2013.01); *D10B 2403/0114* (2013.01); *D10B 2403/022* (2013.01); *D10B 2403/0241* (2013.01); *D10B 2403/032* (2013.01); *D10B 2501/043* (2013.01)

(58) Field of Classification Search

CPC .. A43B 1/04; A43B 1/00; A43B 3/242; A43B 23/0205; A43B 23/0295; A43B 23/02; D10B 2501/043; A41B 11/003; D04B 1/265

USPC ..... 36/84, 45, 48, 83; 2/239; 66/185

See application file for complete search history.

(56) References Cited

U.S. PATENT DOCUMENTS

| | | | |
|---|---|---|---|
| 74,962 | A | 2/1868 | Martin |
| 275,142 | A | 4/1883 | Carter |
| 299,934 | A | 3/1884 | Muller |
| 467,091 | A | 1/1892 | Max |
| 578,153 | A | 3/1897 | Lamb |
| 601,192 | A | 3/1898 | Woodwide |
| 601,894 | A | 4/1898 | Lamb |

(Continued)

FOREIGN PATENT DOCUMENTS

| | | |
|---|---|---|
| AT | 386324 | 8/1988 |
| CA | 989720 | 5/1976 |

(Continued)

OTHER PUBLICATIONS

"Adjacent", dictionary.com. Web. retrieved Jun. 8, 2019. https://www.dictionary.com/browse/adjacent.*

(Continued)

*Primary Examiner* — Jillian K Pierorazio

(74) *Attorney, Agent, or Firm* — Kilpatrick Townsend & Stockton LLP

(57) ABSTRACT

Described are uppers for a shoe, particularly a sports shoe, having at least one first partial area and at least one second partial area that are manufactured as one-piece knitwear, wherein the first partial area includes a first yarn and the second partial area includes a second yarn, and wherein the first yarn is more elastic than the second yarn.

20 Claims, 11 Drawing Sheets

(56) References Cited

U.S. PATENT DOCUMENTS

D31,023 S 6/1899 Olmsted
757,424 A 4/1904 Vohl
951,033 A 3/1910 Steber
1,215,198 A 2/1917 Rothstein
1,346,516 A 7/1920 Godfrey
1,370,799 A 3/1921 Egerton
1,413,314 A 4/1922 Bosworth
1,413,537 A 4/1922 Jones
1,538,263 A 5/1925 Ackerman
1,597,934 A 8/1926 Stimpson
1,841,518 A 1/1932 Bellak
1,888,172 A 11/1932 Joha
1,902,780 A 3/1933 Holden et al.
RE18,804 E 4/1933 Joha
1,910,251 A 5/1933 Joha
1,972,609 A 9/1934 Arsdale et al.
2,001,293 A 5/1935 Wilson
2,018,275 A 10/1935 Jack
2,024,180 A 12/1935 Parlante
2,038,844 A 4/1936 Dorf
2,042,146 A 5/1936 Deakin
2,047,724 A 7/1936 Zuckerman
2,048,294 A 7/1936 Roberts
2,069,083 A 1/1937 Percy
2,076,285 A 4/1937 Wiggin
2,126,186 A 8/1938 Friedland
2,147,197 A * 2/1939 Glidden ..... A43B 1/02 36/3 A
2,150,730 A 3/1939 Schuessler
2,165,092 A 7/1939 Daniels
2,171,654 A 9/1939 Ralph et al.
2,178,941 A 11/1939 Schuessler
2,257,390 A 9/1941 Roy
2,276,920 A 3/1942 Charles et al.
2,292,455 A 8/1942 Hollier et al.
2,297,028 A 9/1942 Sheeler
2,302,167 A 11/1942 Austin
2,314,098 A 3/1943 McDonald
2,319,141 A 5/1943 Kuehnel
2,330,199 A 9/1943 Basch
2,343,390 A 3/1944 Ushakoff
2,400,692 A 5/1946 Herbert
2,424,957 A 7/1947 Schletter
2,440,393 A 4/1948 Clark
2,460,674 A 2/1949 Lajos
2,464,301 A 3/1949 Francis, Jr.
2,467,237 A 4/1949 Sherman et al.
2,516,697 A 7/1950 Haddad
2,538,673 A 1/1951 Ansley
2,569,764 A 10/1951 Jonas
2,584,084 A 1/1952 Rubico
2,586,045 A 2/1952 Hoza
2,603,891 A 7/1952 Gustav
2,608,078 A 8/1952 Anderson
2,623,373 A 12/1952 Vogel
2,641,004 A 6/1953 Whiting et al.
2,675,631 A 4/1954 Doughty
2,679,117 A 5/1954 Reed
2,701,458 A 2/1955 Ducharme
2,712,744 A 7/1955 Miller et al.
2,714,813 A 8/1955 Roscoe
2,783,631 A 3/1957 Sumner
2,811,029 A 10/1957 Conner
2,848,885 A 8/1958 Goodman
2,898,754 A 8/1959 Harms
2,934,839 A 5/1960 Servin
2,948,132 A 8/1960 Gift
2,966,785 A 1/1961 Goff et al.
2,983,128 A 5/1961 Goff et al.
2,994,322 A 8/1961 Cullen et al.
3,004,354 A 10/1961 Lewis
3,013,564 A 12/1961 Harold
3,015,943 A 1/1962 Guy
3,035,291 A 5/1962 Bingham, Jr.
3,063,074 A 11/1962 Scholl
3,070,909 A 1/1963 Hermann et al.
3,078,699 A 2/1963 Huntley
3,093,916 A 6/1963 Hiestand et al.
3,138,880 A 6/1964 Kunzli
3,159,988 A 12/1964 Reymes
3,217,336 A 11/1965 Joseph
3,228,819 A 1/1966 Bingham, Jr.
3,298,204 A 1/1967 Hoffecker
3,324,220 A 6/1967 Stansfield
3,370,363 A 2/1968 Kaplan
3,416,174 A 12/1968 Novitske
3,425,246 A 2/1969 Knohl
3,550,402 A 12/1970 Colton
3,583,081 A 6/1971 Hayashi
3,616,149 A 10/1971 Wincklhofer et al.
3,620,892 A 11/1971 Wincklhofer et al.
3,635,051 A 1/1972 Betts et al.
3,656,323 A 4/1972 Brown
3,694,940 A 10/1972 Stohr
3,695,063 A 10/1972 Betts et al.
3,704,474 A 12/1972 Winkler
3,766,566 A 10/1973 Tadokoro et al.
3,769,723 A 11/1973 Masterson et al.
3,778,856 A 12/1973 Christie et al.
3,785,173 A 1/1974 Hanney et al.
3,838,583 A 10/1974 Rumi et al.
3,863,272 A 2/1975 Guille
3,867,248 A 2/1975 Bauer
3,884,052 A 5/1975 Findlay et al.
3,952,427 A 4/1976 von den Benken et al.
3,967,390 A 7/1976 Anfruns
3,971,234 A 7/1976 Taylor
3,972,086 A 8/1976 Belli et al.
3,985,003 A 10/1976 Reed
3,985,004 A 10/1976 Johnson et al.
4,027,402 A 6/1977 Liu et al.
4,028,910 A 6/1977 Wignall et al.
4,031,586 A 6/1977 von den Benken et al.
4,038,699 A 8/1977 Burn
4,038,840 A 8/1977 Castello
4,068,395 A 1/1978 Senter
4,075,383 A 2/1978 Anderson et al.
4,111,008 A 9/1978 Robinson et al.
4,120,101 A 10/1978 Drew
4,144,727 A 3/1979 Duhl et al.
4,183,156 A 1/1980 Rudy et al.
4,211,806 A 7/1980 Civardi et al.
4,219,945 A 9/1980 Rudy et al.
4,232,458 A 11/1980 Bartels
4,233,758 A 11/1980 Auberry
4,255,949 A 3/1981 Thorneburg
4,258,480 A 3/1981 Famolare et al.
4,265,954 A 5/1981 Romanek
4,276,671 A 7/1981 Melton
4,279,049 A 7/1981 Coiquaud
4,282,657 A 8/1981 Antonious
4,306,315 A 12/1981 Castiglia
4,306,929 A 12/1981 Menikheim et al.
4,317,292 A 3/1982 Melton
4,324,752 A 4/1982 Newton et al.
4,354,318 A 10/1982 Frederick et al.
4,373,361 A 2/1983 Thorneburg
4,430,811 A 2/1984 Okada
4,447,967 A 5/1984 Zaino
4,465,448 A 8/1984 Aldridge et al.
4,467,626 A 8/1984 Coble et al.
4,523,346 A 6/1985 Auberry et al.
4,531,525 A 7/1985 Richards
4,592,154 A 6/1986 Oatman
4,607,439 A 8/1986 Harada
4,610,685 A 9/1986 Raley
4,624,115 A 11/1986 Safrit et al.
4,642,915 A 2/1987 Pfander
4,651,354 A 3/1987 Petrey
4,663,946 A 5/1987 Wright
4,669,126 A 6/1987 Jones
4,682,479 A 7/1987 Pernick
4,722,202 A 2/1988 Imboden
4,729,179 A 3/1988 Quist et al.

(56) References Cited

U.S. PATENT DOCUMENTS 4,737,396 A 4/1988 Kamat et al.
4,750,339 A 6/1988 Simpson, Jr. et al.
4,756,098 A 7/1988 Boggia
4,783,355 A 11/1988 Mueller
4,785,558 A 11/1988 Shiomura
4,813,158 A 3/1989 Brown
4,813,161 A 3/1989 Lesley
4,852,272 A 8/1989 Chilewich et al.
4,899,465 A 2/1990 Bleimhofer et al.
4,941,331 A 7/1990 Cournoyer et al.
4,960,135 A 10/1990 Nelson
5,031,423 A 7/1991 Ikenaga et al.
5,095,720 A 3/1992 Tibbals
5,117,567 A 6/1992 Berger et al.
5,125,116 A 6/1992 Gaither et al.
5,152,025 A 10/1992 Hirmas et al.
5,157,791 A 10/1992 Woodson et al.
5,181,278 A 1/1993 Peleg et al.
5,192,601 A 3/1993 Neisler
5,240,773 A 8/1993 Dunn et al.
5,253,434 A 10/1993 Curley, Jr. et al.
5,291,671 A 3/1994 Caberlotto et al.
5,319,807 A 6/1994 Brier
5,323,627 A 6/1994 Lonati et al.
5,343,639 A 9/1994 Kilgore et al.
5,345,638 A 9/1994 Nishida
5,353,523 A 10/1994 Kilgore et al.
5,353,524 A 10/1994 Brier
5,371,957 A 12/1994 Gaudio et al.
5,385,036 A 1/1995 Spillane et al.
5,388,430 A 2/1995 Essig
5,426,869 A 6/1995 Gore et al.
5,461,884 A 10/1995 McCartney et al.
5,479,791 A 1/1996 Osborne
5,484,646 A 1/1996 Mann
5,505,011 A 4/1996 Bleimhofer et al.
5,511,323 A 4/1996 Dahlgren
5,513,450 A 5/1996 Aviles
5,519,894 A 5/1996 Imboden et al.
5,526,584 A 6/1996 Bleimhofer et al.
5,553,468 A 9/1996 Osborne
5,560,227 A 10/1996 Depoe et al.
5,572,860 A 11/1996 Mitsumoto et al.
5,575,090 A 11/1996 Condini
5,581,817 A 12/1996 Hicks
5,592,836 A 1/1997 Schuster et al.
5,605,060 A 2/1997 Osborne
5,606,808 A 3/1997 Gilliard et al.
5,623,734 A 4/1997 Pugliatti
5,623,840 A 4/1997 Roell
5,708,985 A * 1/1998 Ogden ..... A41B 11/02 2/239
5,709,107 A 1/1998 Jeffcoat
5,711,093 A 1/1998 Aumann
5,711,168 A 1/1998 Proctor et al.
5,722,262 A 3/1998 Proctor et al.
5,729,918 A 3/1998 Smets et al.
5,735,145 A 4/1998 Pernick
5,737,857 A 4/1998 Aumann
5,737,943 A 4/1998 Bernhardt
5,746,013 A 5/1998 Fay, Sr.
5,765,296 A 6/1998 Ludemann et al.
5,774,898 A 7/1998 Malpee
5,784,806 A 7/1998 Wendt
5,787,503 A 8/1998 Murphy, III
5,791,163 A 8/1998 Throneburg
5,836,179 A 11/1998 Van
5,850,745 A 12/1998 Albright
5,855,123 A 1/1999 Albright
5,884,419 A 3/1999 Davidowitz et al.
5,896,608 A 4/1999 Whatley
5,896,683 A 4/1999 Foxen et al.
5,896,758 A 4/1999 Rock et al.
5,906,007 A 5/1999 Roberts
5,996,189 A 12/1999 Wang et al.
6,021,585 A 2/2000 Cole
6,029,376 A 2/2000 Cass
6,032,387 A 3/2000 Johnson
6,052,921 A 4/2000 Oreck
6,088,936 A 7/2000 Bahl et al.
6,109,068 A 8/2000 Stoll et al.
6,128,835 A 10/2000 Ritter et al.
6,151,802 A 11/2000 Reynolds et al.
6,158,253 A 12/2000 Frank et al.
6,170,175 B1 1/2001 Funk et al.
6,173,589 B1 1/2001 Hayes, Jr. et al.
6,192,717 B1 2/2001 Rabinowicz
6,196,030 B1 3/2001 Stoll et al.
6,227,010 B1 5/2001 Roell
6,231,946 B1 5/2001 Brown, Jr. et al.
6,250,115 B1 6/2001 Suzuki
6,272,888 B1 8/2001 Fujita et al.
6,286,233 B1 9/2001 Gaither
6,287,168 B1 9/2001 Rabinowicz
6,299,962 B1 10/2001 Davis et al.
6,301,759 B1 10/2001 Langer et al.
6,308,438 B1 10/2001 Throneburg et al.
6,330,814 B1 12/2001 Fujiwara
6,333,105 B1 12/2001 Tanaka et al.
6,401,364 B1 6/2002 Burt et al.
6,415,632 B1 7/2002 Vesnaver
6,449,878 B1 9/2002 Lyden
6,539,752 B1 4/2003 Apollonio
6,558,784 B1 5/2003 Norton et al.
6,588,237 B2 7/2003 Cole et al.
6,622,312 B2 9/2003 Rabinowicz
6,662,469 B2 12/2003 Belley et al.
6,665,955 B1 12/2003 Mizrahi et al.
6,708,348 B1 3/2004 Romay
6,735,988 B1 5/2004 Honeycutt
6,754,983 B2 6/2004 Hatfield et al.
6,779,369 B2 8/2004 Shepherd
6,871,515 B1 3/2005 Starbuck et al.
6,886,367 B2 5/2005 Mitchell et al.
6,899,591 B2 5/2005 Mitchell
6,910,288 B2 6/2005 Dua
6,922,917 B2 8/2005 Kerns et al.
6,931,762 B1 8/2005 Dua
6,944,975 B2 9/2005 Safdeye et al.
6,984,596 B2 1/2006 Dickerson
6,986,183 B2 1/2006 Delgorgue et al.
6,986,269 B2 1/2006 Dua
D517,297 S 3/2006 Jones et al.
7,016,867 B2 3/2006 Lyden
7,037,571 B2 5/2006 Fish et al.
7,043,942 B2 5/2006 Chapman
7,047,668 B2 5/2006 Burris et al.
7,051,460 B2 5/2006 Orei et al.
7,055,267 B2 6/2006 Wilson et al.
7,056,402 B2 6/2006 Koerwien et al.
7,107,235 B2 9/2006 Lyden
7,131,296 B2 11/2006 Dua et al.
7,179,414 B2 2/2007 Safdeye et al.
7,207,125 B2 4/2007 Jeppesen et al.
7,207,196 B2 4/2007 Lonati et al.
7,207,961 B1 4/2007 Benton et al.
7,240,522 B2 7/2007 Kondou et al.
7,346,935 B1 3/2008 Patterson
7,347,011 B2 3/2008 Dua et al.
7,356,946 B2 4/2008 Hannon et al.
7,441,348 B1 10/2008 Dawson et al.
7,543,397 B2 6/2009 Kilgore et al.
7,568,298 B2 8/2009 Kerns et al.
7,637,032 B2 12/2009 Sokolowski et al.
7,650,705 B2 1/2010 Donnadieu et al.
7,677,061 B2 3/2010 Mori et al.
7,682,219 B2 3/2010 Falla
7,721,575 B2 5/2010 Yokoyama
7,774,956 B2 8/2010 Dua et al.
7,805,860 B2 10/2010 Fliri et al.
7,814,598 B2 10/2010 Dua et al.
7,854,076 B2 12/2010 Keppler et al.
7,882,648 B2 2/2011 Langvin
8,028,440 B2 10/2011 Sokolowski et al.

(56) References Cited

U.S. PATENT DOCUMENTS 8,042,288 B2 10/2011 Dua et al.
8,099,881 B2 1/2012 Yamamoto
8,196,317 B2 6/2012 Dua et al.
8,209,883 B2 7/2012 Lyden
8,215,132 B2 7/2012 Dua et al.
8,225,530 B2 7/2012 Sokolowski et al.
8,266,749 B2 9/2012 Dua et al.
8,296,970 B2 10/2012 Jessiman et al.
D673,765 S 1/2013 Parker et al.
8,448,474 B1 5/2013 Tatler et al.
8,490,299 B2 7/2013 Dua et al.
8,522,577 B2 9/2013 Huffa
8,590,345 B2 11/2013 Sokolowski et al.
8,595,878 B2 12/2013 Faris et al.
8,621,891 B2 1/2014 Shaffer et al.
8,650,916 B2 2/2014 Thomas et al.
8,683,718 B2 4/2014 Fliri et al.
8,701,232 B1 4/2014 Droege et al.
8,745,895 B2 6/2014 Sokolowski et al.
8,745,896 B2 6/2014 Shaffer et al.
8,800,172 B2 8/2014 Dua et al.
8,839,532 B2 9/2014 Shaffer et al.
8,881,430 B2 11/2014 Baines et al.
8,898,932 B2 12/2014 Molyneux et al.
8,899,079 B2 12/2014 Podhajny et al.
8,959,800 B2 2/2015 Sokolowski et al.
8,959,959 B1 2/2015 Podhajny et al.
8,973,410 B1 3/2015 Podhajny et al.
8,978,422 B2 3/2015 Podhajny et al.
8,997,529 B1 4/2015 Podhajny et al.
8,997,530 B1 4/2015 Podhajny
9,003,836 B1 4/2015 Podhajny et al.
9,010,157 B1 4/2015 Podhajny et al.
9,027,260 B2 5/2015 Shaffer et al.
9,032,763 B2 5/2015 Meir et al.
9,060,562 B2 6/2015 Meir et al.
9,072,335 B1 7/2015 Podhajny
9,078,488 B1 7/2015 Podhajny et al.
9,084,449 B2 7/2015 Huffman et al.
9,095,187 B2 8/2015 Molyneux et al.
9,132,601 B2 9/2015 Beye et al.
9,139,938 B2 9/2015 Podhajny et al.
9,145,629 B2 9/2015 Podhajny
9,150,986 B2 10/2015 Shaffer et al.
9,192,204 B1 11/2015 Klug et al.
9,226,540 B2 1/2016 Podhajny et al.
9,297,097 B2 3/2016 Turner
9,301,567 B2 4/2016 Roulo et al.
9,339,076 B2 5/2016 Podhajny et al.
9,353,469 B2 5/2016 Meir et al.
9,357,813 B2 6/2016 Lyden
9,365,959 B2 6/2016 Turner
9,375,046 B2 6/2016 Meir
9,398,784 B2 7/2016 Baudouin et al.
9,498,023 B2 11/2016 Craig
9,723,890 B2 8/2017 Long et al.
2001/0016993 A1 8/2001 Cagner
2001/0024709 A1 9/2001 Yoneda et al.
2001/0032399 A1 10/2001 Litchfield et al.
2001/0054240 A1 12/2001 Bordin et al.
2001/0055684 A1 12/2001 Davis et al.
2002/0000002 A1 1/2002 Hatch et al.
2002/0002780 A1 1/2002 Barthelemy et al.
2002/0007570 A1 1/2002 Girard
2002/0012784 A1 1/2002 Norton et al.
2002/0026730 A1 3/2002 Whatley
2002/0053148 A1 5/2002 Haimerl et al.
2002/0078599 A1 6/2002 Delgorgue et al.
2002/0092199 A1 7/2002 Fish et al.
2002/0148142 A1 10/2002 Oorei et al.
2002/0148258 A1 10/2002 Cole et al.
2002/0152638 A1 10/2002 Safdeye et al.
2003/0009908 A1 1/2003 Sheets et al.
2003/0009919 A1 1/2003 Stein
2003/0033837 A1 2/2003 Higgins
2003/0039882 A1 2/2003 Wruck et al.
2003/0051372 A1 3/2003 Lyden
2003/0069807 A1 4/2003 Lyden
2003/0079374 A1 5/2003 Belley et al.
2003/0097766 A1 5/2003 Morgan
2003/0106171 A1 6/2003 Issler
2003/0126762 A1 7/2003 Tseng
2003/0131499 A1 7/2003 Silverman
2003/0191427 A1 10/2003 Jay et al.
2003/0192351 A1 10/2003 Meckley et al.
2003/0226280 A1 12/2003 Paratore et al.
2003/0227105 A1 12/2003 Paratore et al.
2004/0009731 A1 1/2004 Rabinowicz
2004/0045955 A1 3/2004 Rock et al.
2004/0083622 A1 5/2004 Mizrahi et al.
2004/0111920 A1 6/2004 Cretinon
2004/0111921 A1 6/2004 Lenormand
2004/0118018 A1 6/2004 Dua
2004/0139628 A1 7/2004 Wiener et al.
2004/0139629 A1 7/2004 Wiener et al.
2004/0143995 A1 7/2004 Mcclelland
2004/0163280 A1 8/2004 Morris et al.
2004/0181972 A1 9/2004 Csorba
2004/0198178 A1 10/2004 Mitchell et al.
2004/0205982 A1 10/2004 Challe
2004/0216332 A1 11/2004 Wilson et al.
2004/0226113 A1 11/2004 Wright et al.
2004/0255486 A1 12/2004 Pawlus et al.
2004/0261467 A1 12/2004 Chapman
2005/0016023 A1 1/2005 Burris et al.
2005/0028405 A1 2/2005 Wilson et al.
2005/0055843 A1 3/2005 Morlacchi
2005/0081402 A1 4/2005 Orei et al.
2005/0091725 A1 5/2005 Alley et al.
2005/0102863 A1 5/2005 Hannon et al.
2005/0108898 A1 5/2005 Jeppesen et al.
2005/0115281 A1 6/2005 Mitchell et al.
2005/0115284 A1* 6/2005 Dua ..... A43B 1/04 66/178 R
2005/0127057 A1 6/2005 Rock et al.
2005/0138845 A1 6/2005 Haimerl et al.
2005/0155137 A1 7/2005 Berger
2005/0166426 A1 8/2005 Donnadieu et al.
2005/0166427 A1 8/2005 Greene et al.
2005/0193592 A1* 9/2005 Dua ..... A43B 1/04 36/45
2005/0208857 A1 9/2005 Baron et al.
2005/0268497 A1 12/2005 Alfaro et al.
2005/0273988 A1 12/2005 Christy et al.
2005/0284000 A1 12/2005 Kerns
2006/0006168 A1 1/2006 Rock et al.
2006/0016099 A1 1/2006 Marco et al.
2006/0021258 A1 2/2006 Beck
2006/0048413 A1 3/2006 Sokolowski et al.
2006/0059715 A1 3/2006 Aveni
2006/0059716 A1 3/2006 Yamashita et al.
2006/0117607 A1 6/2006 Pare et al.
2006/0130359 A1* 6/2006 Dua ..... A43B 1/04 36/9 R
2006/0162187 A1 7/2006 Byrnes et al.
2006/0179549 A1 8/2006 Huggins et al.
2006/0243000 A1 11/2006 Turlan et al.
2007/0000027 A1 1/2007 Ganzoni et al.
2007/0003728 A1 1/2007 Hannon et al.
2007/0022627 A1* 2/2007 Sokolowski ..... A43B 1/04 36/3 A
2007/0074334 A1 4/2007 Steel et al.
2007/0144039 A1 6/2007 Fliri
2007/0180730 A1 8/2007 Greene et al.
2007/0234593 A1 10/2007 Beck et al.
2007/0271817 A1 11/2007 Ellis et al.
2007/0283483 A1* 12/2007 Jacober ..... A41B 11/00 2/239
2008/0000108 A1 1/2008 Ellis et al.
2008/0010860 A1 1/2008 Gyr
2008/0017294 A1 1/2008 Bailey et al.
2008/0032580 A1 2/2008 Fukuoka et al.
2008/0066499 A1 3/2008 Andrieu et al.
2008/0078102 A1 4/2008 Kilgore et al.

(56) References Cited

U.S. PATENT DOCUMENTS

2008/0110048 A1 5/2008 Dua et al.
2008/0110049 A1 5/2008 Sokolowski et al.
2008/0155731 A1* 7/2008 Kasahara ..... D04B 1/265 2/240
2008/0189830 A1 8/2008 Egglesfield et al.
2008/0250668 A1 10/2008 Marvin et al.
2008/0263893 A1 10/2008 Hernandez et al.
2008/0295230 A1* 12/2008 Wright ..... A41D 13/0015 2/455
2008/0313939 A1 12/2008 Ardill et al.
2009/0068908 A1 3/2009 Hinchcliff et al.
2009/0071036 A1 3/2009 Hooper et al.
2009/0107012 A1 4/2009 Cheney et al.
2009/0126225 A1 5/2009 Jarvis
2009/0126229 A1 5/2009 Fuerst et al.
2009/0134145 A1 5/2009 Rock et al.
2009/0172971 A1 7/2009 Peikert et al.
2009/0241374 A1 10/2009 Sato et al.
2009/0297794 A1 12/2009 Lin
2010/0018075 A1 1/2010 Meschter et al.
2010/0043253 A1 2/2010 Dojan et al.
2010/0051132 A1 3/2010 Glenn et al.
2010/0064453 A1 3/2010 Haimerl
2010/0107346 A1 5/2010 Aveni et al.
2010/0107443 A1 5/2010 Aveni et al.
2010/0154256 A1* 6/2010 Dua ..... A43B 1/04 36/25 R
2010/0170651 A1 7/2010 Scherb et al.
2010/0175276 A1 7/2010 Dojan et al.
2010/0269372 A1 10/2010 Dua et al.
2010/0299962 A1 12/2010 Fliri
2011/0030244 A1 2/2011 Motawi et al.
2011/0061149 A1 3/2011 Polacco et al.
2011/0061265 A1 3/2011 Lyden
2011/0078921 A1 4/2011 Greene et al.
2011/0088282 A1 4/2011 Dojan et al.
2011/0154689 A1 6/2011 Chung
2011/0154693 A1 6/2011 Oberschneider et al.
2011/0179677 A1 7/2011 Jessiman et al.
2011/0302727 A1 12/2011 Sokolowski et al.
2011/0302810 A1 12/2011 Borel et al.
2011/0308108 A1 12/2011 Berns et al.
2011/0308110 A1 12/2011 Berns et al.
2012/0023686 A1 2/2012 Huffa et al.
2012/0023778 A1 2/2012 Dojan et al.
2012/0055044 A1 3/2012 Dojan et al.
2012/0090077 A1 4/2012 Brown et al.
2012/0114883 A1 5/2012 Kapur et al.
2012/0144699 A1 6/2012 Eggert et al.
2012/0159813 A1 6/2012 Dua et al.
2012/0180195 A1* 7/2012 Shull ..... A41B 11/003 2/239
2012/0198730 A1 8/2012 Burch et al.
2012/0204448 A1 8/2012 Bracken
2012/0216423 A1 8/2012 Lyden
2012/0216430 A1 8/2012 Stöhr
2012/0233878 A1 9/2012 Hazenberg et al.
2012/0233879 A1 9/2012 Dojan et al.
2012/0233880 A1 9/2012 Chao et al.
2012/0233882 A1 9/2012 Huffa et al.
2012/0233883 A1 9/2012 Spencer et al.
2012/0233884 A1 9/2012 Greene
2012/0233885 A1 9/2012 Shaffer et al.
2012/0233886 A1 9/2012 Madore et al.
2012/0233887 A1 9/2012 Baker et al.
2012/0233888 A1 9/2012 Baker et al.
2012/0234051 A1 9/2012 Huffa
2012/0234052 A1 9/2012 Huffa et al.
2012/0234111 A1 9/2012 Molyneux et al.
2012/0234467 A1 9/2012 Rapaport et al.
2012/0235322 A1 9/2012 Greene et al.
2012/0238376 A1 9/2012 Knight et al.
2012/0238910 A1 9/2012 Nordstrom
2012/0240429 A1 9/2012 Sokolowski et al.
2012/0246973 A1 10/2012 Dua
2012/0255201 A1* 10/2012 Little ..... A43B 1/04 36/84
2012/0272548 A1 11/2012 Downard et al.
2012/0279260 A1* 11/2012 Dua ..... D04B 1/16 66/171
2012/0285039 A1 11/2012 Lazaris et al.
2012/0285043 A1 11/2012 Dua et al.
2012/0297642 A1 11/2012 Schaefer et al.
2012/0297643 A1 11/2012 Shaffer et al.
2012/0297645 A1 11/2012 Berbert et al.
2012/0318026 A1 12/2012 Dua et al.
2013/0031801 A1 2/2013 Hatfield et al.
2013/0036629 A1 2/2013 Bramani et al.
2013/0047471 A1 2/2013 Liang
2013/0055590 A1 3/2013 Mokos
2013/0061405 A1 3/2013 Haimerl
2013/0091741 A1 4/2013 Frank et al.
2013/0118031 A1 5/2013 Chenciner et al.
2013/0139407 A1 6/2013 Brongers et al.
2013/0145652 A1 6/2013 Podhajny
2013/0152424 A1 6/2013 Dojan et al.
2013/0160323 A1 6/2013 Hsiao et al.
2013/0174449 A1 7/2013 Koyess et al.
2013/0219749 A1 8/2013 Dojan et al.
2013/0232820 A1 9/2013 Bramani et al.
2013/0239438 A1 9/2013 Dua et al.
2013/0255103 A1 10/2013 Dua et al.
2013/0260104 A1 10/2013 Dua et al.
2013/0260629 A1 10/2013 Dua et al.
2013/0269209 A1 10/2013 Lang
2014/0068968 A1 3/2014 Podhajny et al.
2014/0082965 A1 3/2014 Greene et al.
2014/0101824 A1 4/2014 Spanks et al.
2014/0123409 A1 5/2014 Huffa et al.
2014/0130373 A1 5/2014 Baines et al.
2014/0130374 A1 5/2014 Minami et al.
2014/0130375 A1 5/2014 Baines et al.
2014/0130376 A1 5/2014 Fahmi et al.
2014/0137433 A1 5/2014 Craig et al.
2014/0137434 A1 5/2014 Craig
2014/0144190 A1 5/2014 Tatler et al.
2014/0150292 A1 6/2014 Podhajny et al.
2014/0150295 A1 6/2014 Dua et al.
2014/0150296 A1 6/2014 Dua et al.
2014/0157831 A1 6/2014 Huffa et al.
2014/0173934 A1* 6/2014 Bell ..... D03D 13/002 36/84
2014/0196314 A1 7/2014 Beye et al.
2014/0209233 A1 7/2014 Dua et al.
2014/0237855 A1 8/2014 Podhajny et al.
2014/0237856 A1 8/2014 Podhajny et al.
2014/0238082 A1 8/2014 Meir et al.
2014/0238083 A1 8/2014 Meir et al.
2014/0245544 A1 9/2014 Huffa et al.
2014/0245546 A1 9/2014 Huffa et al.
2014/0245547 A1 9/2014 Molyneux et al.
2014/0245633 A1 9/2014 Podhajny et al.
2014/0245634 A1 9/2014 Podhajny et al.
2014/0245636 A1 9/2014 Seamarks et al.
2014/0245637 A1 9/2014 Fahmi et al.
2014/0245639 A1 9/2014 Dua et al.
2014/0245643 A1 9/2014 Huffa et al.
2014/0310983 A1 10/2014 Tamm et al.
2014/0310985 A1 10/2014 Tran et al.
2014/0310986 A1 10/2014 Tamm et al.
2014/0338226 A1 11/2014 Zavala
2014/0352082 A1 12/2014 Shaffer et al.
2014/0352173 A1 12/2014 Bell et al.
2015/0013080 A1 1/2015 Thomas et al.
2015/0013188 A1 1/2015 Baines et al.
2015/0013394 A1 1/2015 Huffa
2015/0013395 A1 1/2015 Huffa
2015/0040431 A1 2/2015 Molyneux et al.
2015/0047225 A1 2/2015 Dealey et al.
2015/0059209 A1 3/2015 Dekovic et al.
2015/0059211 A1 3/2015 Podhajny et al.
2015/0075031 A1 3/2015 Podhajny et al.
2015/0101212 A1 4/2015 Dekovic et al.
2015/0143716 A1 5/2015 Savage et al.

(56) References Cited

U.S. PATENT DOCUMENTS

| | | | | |
|---|---|---|---|---|
| 2015/0143720 | A1 | 5/2015 | Avar et al. | |
| 2015/0216254 | A1 | 8/2015 | Podhajny et al. | |
| 2015/0216255 | A1 | 8/2015 | Podhajny | |
| 2015/0216257 | A1 | 8/2015 | Meir et al. | |
| 2015/0223552 | A1 | 8/2015 | Love et al. | |
| 2015/0250256 | A1 | 9/2015 | Podhajny et al. | |
| 2015/0264995 | A1 | 9/2015 | Hilderbrand, IV | |
| 2015/0272261 | A1 | 10/2015 | Huffman et al. | |
| 2015/0272274 | A1* | 10/2015 | Berns | A43B 23/023 36/84 |
| 2015/0342285 | A1 | 12/2015 | Bell et al. | |
| 2015/0359290 | A1 | 12/2015 | Podhajny et al. | |
| 2015/0366293 | A1 | 12/2015 | Clarkson et al. | |
| 2016/0029736 | A1 | 2/2016 | Meir | |
| 2016/0088894 | A1 | 3/2016 | Podhajny et al. | |
| 2016/0088899 | A1 | 3/2016 | Klug et al. | |
| 2016/0090670 | A1 | 3/2016 | Meir | |
| 2016/0095377 | A1 | 4/2016 | Tamm | |
| 2016/0198797 | A1 | 7/2016 | Ikenaka | |
| 2017/0156434 | A1 | 6/2017 | Tamm et al. | |
| 2017/0311650 | A1 | 11/2017 | Hupperets et al. | |
| 2018/0064201 | A1 | 3/2018 | Tran et al. | |

FOREIGN PATENT DOCUMENTS

| | | | |
|---|---|---|---|
| CA | 2387640 | | 4/2003 |
| CN | 2044806 | | 9/1989 |
| CN | 1067566 | | 1/1993 |
| CN | 2187379 | | 1/1995 |
| CN | 2438730 | | 7/2001 |
| CN | 1392833 | | 1/2003 |
| CN | 1411762 | | 4/2003 |
| CN | 1429512 | | 7/2003 |
| CN | 1155597 | | 6/2004 |
| CN | 1960650 | | 5/2007 |
| CN | 101316526 | | 12/2008 |
| CN | 201356120 | | 12/2009 |
| CN | 102939023 | | 2/2013 |
| CN | 104413996 | | 3/2015 |
| DE | 71153 | | 4/1893 |
| DE | 627878 | | 7/1936 |
| DE | 870963 | | 3/1953 |
| DE | 1736512 | | 12/1956 |
| DE | 1785183 | | 3/1959 |
| DE | 1084173 | | 6/1960 |
| DE | 1910713 | | 7/1970 |
| DE | 1785183 | | 11/1971 |
| DE | 2044031 | | 3/1972 |
| DE | 1685690 | | 1/1973 |
| DE | 2162456 | | 6/1973 |
| DE | 2305693 | | 8/1973 |
| DE | 2505537 | | 8/1976 |
| DE | 2801984 | | 7/1979 |
| DE | 3820094 | | 12/1989 |
| DE | 4400739 | | 7/1995 |
| DE | 68922952 | | 11/1995 |
| DE | 4419802 | | 12/1995 |
| DE | 4419803 | | 12/1995 |
| DE | 4441555 | | 6/1996 |
| DE | 19629317 | | 10/1997 |
| DE | 19738433 | | 4/1998 |
| DE | 19728848 | | 1/1999 |
| DE | 4443002 | | 2/1999 |
| DE | 19855542 | | 6/2000 |
| DE | 19910785 | | 9/2000 |
| DE | 10022254 | | 11/2001 |
| DE | 10145073 | | 4/2003 |
| DE | 10228143 | | 11/2003 |
| DE | 3903242 | | 7/2004 |
| DE | 4138836 | | 7/2004 |
| DE | 19910785 | | 12/2004 |
| DE | 1991110785 | B4 | 12/2004 |
| DE | 602004000536 | | 12/2006 |
| DE | 102005030651 | | 1/2007 |
| DE | 10316979 | | 2/2007 |
| DE | 60031821 | | 9/2007 |
| DE | 102006009974 | | 9/2007 |
| DE | 102006022494 | | 11/2007 |
| DE | 202007011165 | | 1/2008 |
| DE | 202009010225 | | 2/2010 |
| DE | 202009011928 | | 2/2010 |
| DE | 102009018942 | | 11/2010 |
| DE | 102009028627 | | 3/2011 |
| DE | 102010037585 | | 3/2012 |
| DE | 102011055154 | | 5/2012 |
| DE | 202012100938 | | 5/2012 |
| DE | 202007019490 | | 1/2013 |
| DE | 202009018763 | | 4/2013 |
| DE | 202009018765 | | 4/2013 |
| DE | 102012206062 | | 10/2013 |
| DE | 202012013113 | | 11/2014 |
| DE | 202012013114 | | 11/2014 |
| DE | 202012013118 | | 11/2014 |
| DE | 202012013119 | | 11/2014 |
| DE | 202012013120 | | 11/2014 |
| EP | 0037629 | | 10/1981 |
| EP | 45372 | | 2/1982 |
| EP | 0105773 | | 4/1984 |
| EP | 279950 | | 8/1988 |
| EP | 0384059 | | 8/1990 |
| EP | 446583 | | 9/1991 |
| EP | 0472743 | | 3/1992 |
| EP | 499710 | | 8/1992 |
| EP | 508712 | | 10/1992 |
| EP | 0664092 | | 7/1995 |
| EP | H07-246101 | A | 9/1995 |
| EP | 448714 | | 7/1996 |
| EP | 728860 | | 8/1996 |
| EP | 0733732 | | 9/1996 |
| EP | 758693 | | 2/1997 |
| EP | 845553 | | 6/1998 |
| EP | 864681 | | 9/1998 |
| EP | 898002 | | 2/1999 |
| EP | 0959704 | | 12/1999 |
| EP | 1004829 | | 5/2000 |
| EP | 1031656 | | 8/2000 |
| EP | 1091033 | | 4/2001 |
| EP | 0758693 | | 10/2001 |
| EP | 0833000 | | 3/2002 |
| EP | 1219191 | | 7/2002 |
| EP | 1233091 | | 8/2002 |
| EP | 1273693 | | 1/2003 |
| EP | 1275761 | | 1/2003 |
| EP | 1437057 | | 7/2004 |
| EP | 1148161 | | 4/2005 |
| EP | 1563752 | | 8/2005 |
| EP | 1602762 | | 12/2005 |
| EP | 1352118 | | 10/2006 |
| EP | 1972706 | | 9/2008 |
| EP | 1571938 | | 11/2008 |
| EP | 2023762 | | 2/2009 |
| EP | 2079336 | | 7/2009 |
| EP | 2088887 | | 8/2009 |
| EP | 2248434 | | 11/2010 |
| EP | 2378910 | | 10/2011 |
| EP | 1919321 | | 8/2012 |
| EP | 2485619 | | 8/2012 |
| EP | 2520188 | | 11/2012 |
| EP | 1571938 | | 5/2013 |
| EP | 2088887 | | 5/2013 |
| EP | 2591694 | | 5/2013 |
| EP | 2649898 | | 10/2013 |
| EP | 2716177 | | 7/2014 |
| EP | 2803283 | | 1/2015 |
| EP | 2904920 | | 8/2015 |
| EP | 2952346 | | 12/2015 |
| EP | 2977205 | | 1/2016 |
| EP | 2686467 | | 4/2016 |
| EP | 2713793 | | 6/2016 |
| EP | 2505092 | | 8/2016 |
| FR | 858875 | | 12/1940 |
| FR | 862088 | | 2/1941 |
| FR | 2171172 | | 9/1973 |

(56) References Cited

FOREIGN PATENT DOCUMENTS

| | | | |
|---|---|---|---|
| FR | 2491739 | | 9/1982 |
| FR | 2506576 | | 12/1984 |
| FR | 2504786 | | 1/1986 |
| FR | 2648684 | | 12/1990 |
| FR | 2776485 | | 4/2000 |
| FR | 2780619 | | 9/2000 |
| FR | 2784550 | | 1/2001 |
| FR | 2848807 | | 7/2013 |
| GB | 109091 | | 8/1917 |
| GB | 273968 | | 7/1927 |
| GB | 323457 | | 1/1930 |
| GB | 413279 | | 7/1934 |
| GB | 538865 | | 8/1941 |
| GB | 674835 | | 7/1952 |
| GB | 761519 | | 11/1956 |
| GB | 782562 | | 9/1957 |
| GB | 832518 | | 4/1960 |
| GB | 1102447 | | 2/1968 |
| GB | 1219433 | | 1/1971 |
| GB | 1328693 | | 8/1973 |
| GB | 1539886 | | 2/1979 |
| GB | 2018837 | | 10/1979 |
| GB | 1572493 | | 7/1980 |
| GB | 1581999 | | 12/1980 |
| GB | 1603487 | | 11/1981 |
| GB | 2044073 | | 3/1983 |
| GB | 2131677 | | 6/1984 |
| GB | 2133273 | | 7/1984 |
| GB | 2214939 | | 4/1992 |
| GB | 317184 | | 8/2003 |
| GB | 413017 | | 7/2004 |
| GB | 2408190 | | 5/2005 |
| JP | S39-16845 | | 6/1939 |
| JP | S59-166706 | U | 11/1984 |
| JP | S63-057909 | U | 4/1988 |
| JP | 2079336 | | 3/1990 |
| JP | H02-116806 | U | 9/1990 |
| JP | H03-003203 | U | 1/1991 |
| JP | H05-176804 | A | 7/1993 |
| JP | H06-008722 | Y2 | 3/1994 |
| JP | 06113905 | | 4/1994 |
| JP | H06-154001 | A | 6/1994 |
| JP | H06-248501 | A | 9/1994 |
| JP | H06-296507 | A | 10/1994 |
| JP | H0759604 | | 3/1995 |
| JP | H07-148004 | A | 6/1995 |
| JP | 08109553 | | 4/1996 |
| JP | H09-047302 | A | 2/1997 |
| JP | H09-238701 | A | 9/1997 |
| JP | H10-000103 | A | 1/1998 |
| JP | H10-130991 | A | 5/1998 |
| JP | H10-155504 | A | 6/1998 |
| JP | H10-179209 | A | 7/1998 |
| JP | H03-064834 | U | 5/1999 |
| JP | H11-229253 | A | 8/1999 |
| JP | 11302943 | | 11/1999 |
| JP | 2000015732 | | 1/2000 |
| JP | 2000-279201 | A | 10/2000 |
| JP | 2001017206 | | 1/2001 |
| JP | 2001-104091 | A | 4/2001 |
| JP | 2001-164407 | A | 6/2001 |
| JP | 2001-164444 | A | 6/2001 |
| JP | 2002088512 | | 3/2002 |
| JP | 2002146654 | | 5/2002 |
| JP | 2004-230151 | A | 8/2004 |
| JP | 2004-283586 | A | 10/2004 |
| JP | 2006-150064 | A | 6/2006 |
| JP | 2006-249586 | A | 9/2006 |
| JP | 3865307 | B2 | 1/2007 |
| JP | 2007204864 | | 8/2007 |
| JP | 2007-236612 | | 9/2007 |
| JP | 2007-239151 | | 9/2007 |
| JP | 4376792 | | 12/2009 |
| JP | 2010-030289 | A | 2/2010 |
| JP | 2010-163712 | A | 7/2010 |
| JP | 2010-275649 | A | 12/2010 |
| JP | 2011-256506 | A | 12/2011 |
| JP | 2012-500071 | A | 1/2012 |
| JP | 4851688 | B2 | 1/2012 |
| JP | 2012062615 | | 3/2012 |
| JP | 2012-512698 | A | 6/2012 |
| JP | 2012-522551 | A | 9/2012 |
| JP | 2012533404 | | 12/2012 |
| JP | 2013-151783 | A | 8/2013 |
| JP | 2015-025223 | A | 2/2015 |
| NL | 7304678 | | 10/1974 |
| NL | 7505389 | | 11/1975 |
| WO | 9003744 | | 4/1990 |
| WO | 9221806 | | 12/1992 |
| WO | 9843506 | | 10/1998 |
| WO | 9914415 | | 3/1999 |
| WO | 9943229 | | 9/1999 |
| WO | 0032861 | | 6/2000 |
| WO | 0033694 | | 6/2000 |
| WO | 0112003 | | 2/2001 |
| WO | 0112004 | | 2/2001 |
| WO | 0231247 | | 4/2002 |
| WO | 0241721 | | 5/2002 |
| WO | 2002072325 | | 9/2002 |
| WO | 2004064558 | | 8/2004 |
| WO | 2004066770 | | 8/2004 |
| WO | 2004098333 | | 11/2004 |
| WO | 2005004656 | | 1/2005 |
| WO | 2005025841 | | 3/2005 |
| WO | 2005055754 | | 6/2005 |
| WO | 2005074737 | | 8/2005 |
| WO | 2007005459 | | 1/2007 |
| WO | 2009143000 | | 11/2009 |
| WO | 2010020391 | | 2/2010 |
| WO | 2010090923 | | 8/2010 |
| WO | 2011108954 | | 9/2011 |
| WO | 2011138639 | | 11/2011 |
| WO | 2012018731 | | 2/2012 |
| WO | 2012125473 | | 9/2012 |
| WO | 2012125483 | | 9/2012 |
| WO | 2012125490 | | 9/2012 |
| WO | 2012138488 | | 10/2012 |
| WO | 2012151408 | | 11/2012 |
| WO | 2012166602 | | 12/2012 |
| WO | 2012166607 | | 12/2012 |
| WO | 2013126314 | | 8/2013 |
| WO | 2013192363 | | 12/2013 |
| WO | 2014078152 | | 5/2014 |
| WO | 2014078158 | | 5/2014 |
| WO | 2014078160 | | 5/2014 |
| WO | 2014078161 | | 5/2014 |
| WO | 2014081680 | | 5/2014 |
| WO | 2014085205 | | 6/2014 |
| WO | 2014085206 | | 6/2014 |
| WO | 2014113352 | | 7/2014 |
| WO | 2014134236 | | 9/2014 |
| WO | 2014134237 | | 9/2014 |
| WO | 2014134239 | | 9/2014 |
| WO | 2014134242 | | 9/2014 |
| WO | 2014134247 | | 9/2014 |
| WO | 2014137825 | | 9/2014 |
| WO | 2014134244 | | 11/2014 |
| WO | 2015030914 | | 3/2015 |
| WO | 2015076893 | | 5/2015 |
| WO | 2015126613 | A1 | 8/2015 |
| WO | 2015134648 | | 9/2015 |
| WO | 2016018904 | | 2/2016 |

OTHER PUBLICATIONS

"Symmetrical", dictionary.com. Web. retrieved Jun. 8, 2019. https://www.dictionary.com/browse/symmetrical.*

Nike's Motion to Amend filed in IPR2013-00067 on Aug. 19, 2013, 19 pages.

Exhibit 2007, U.S. Pat. No. 7,347,011 with markings filed in IPR2013-00067 on Aug. 19, 2013, 22 pages.

Decision Motion to Withdraw § 42.10(e) filed in IPR2013-00067 on Oct. 30, 2013, 3 pages.

(56) References Cited

OTHER PUBLICATIONS

Petitioner's Opposition to Patent Owner Motion to Amend filed in IPR2013-00067 on Nov. 12, 2013, 20 pages.
Exhibit 1015, Cross Examination Deposition of Raymond Tonkel filed in IPR2013-00067 on Nov. 12, 2013, 114 pages.
Exhibit 1016, Declaration of Sabut Adanur Ph.D. filed in IPR2013-00067 on Nov. 12, 2013, 57 pages.
Exhibit 1017, Excerpt of Knitted Fabrics filed in IPR2013-00067 on Nov. 12, 2013, 73 pages.
Exhibit 1018, Excerpt of Bharat J. Gaijar, Wrap Knit Fabrics filed in IPR2013-00067 on Nov. 12, 2013, 16 pages.
Exhibit 1019, J. Watel, the Milanese Machine: Little Progress Made in Development of Milanese Fabric filed in IPR2013-00067 on Nov. 12, 2013, 4 pages.
Exhibit 1023, Supplemental Declaration of Edward C. Frederick filed in IPR2013-00067 on Nov. 12, 2013, 18 pages.
Patent Owner's Reply to Petitioner's Opposition to Motion to Amend filed in IPR2013-00067 on Dec. 11, 2013, 9 pages.
Exhibit 2015, Excerpts from Celanese Corporation "Man-Made Fiber and Textile Dictionary" filed in IPR2013-00067 on Dec. 11, 2013, 5 pages.
Exhibit 2016, Excerpts from Hoechst Celanese "Dictionary of Fiber & Textile Technology" filed in IPR2013-00067 on Dec. 11, 2013, 4 pages.
Exhibit 2017, Excerpts from Celanese Corporation "Man-Made Fiber and Textile Dictionary" filed in IPR2013-00067 on Dec. 11, 2013, 10 pages.
Exhibit 2018, Excerpts from Hoechst Celanese "Dictionary of Fiber & Textile Technology" filed in IPR2013-00067 on Dec. 11, 2013, 11 pages.
Exhibit 2020, Transcript of Dec. 3, 2013, second cross-examination deposition of Edward C. Frederick filed in IPR2013-00067 on Dec. 11, 2013, 59 pages, 139 pages.
Exhibit 2021, Transcript of Dec. 3, 2013, cross-examination deposition of Sabit Adanur filed in IPR2013-00067 on Dec. 11, 2013, 139 pages.
Petitioner's Motion to Exclude Evidence filed in IPR2013-00067 on Jan. 7, 2014, 8 pages.
Exhibit 2022, Signature page for transcript of Dec. 3, 2013, Frederick deposition (Ex. 2020) filed in IPR2013-00067 on Jan. 7, 2014 1 page.
Exhibit 2023, Signature page for transcript of Dec. 3, 2013, Adanur deposition (Ex. 2021) filed in IPR2013-00067 on Jan. 7, 2014, 1 page.
Order Trial Hearing filed in IPR2013-00067 on Jan. 13, 2014, 4 pages.
Patent Owner Opposition to Motion to Exclude filed in IPR2013-00067 on Jan. 21, 2014, 8 pages.
Order Conduct of the Proceeding § 4.25 filed in IPR2013-00067 on Jan. 23, 2014, 3 pages.
Petitioner's Reply to Patent Owner's Opposition to Petitioner's Motion to Exclude Evidence filed in IPR2013-00067 on Jan. 28, 2014, 8 pages.
Submission of Patent Owner's Trial Hearing Demonstratives filed in IPR2013-00067 on Feb. 6, 2014, 3 pages.
Patent Owner's Trial Hearing Demonstratives filed in IPR2013-00067 on Feb. 6, 2014, 47 pages.
Oral Hearing Transcript filed in IPR2013-00067 on Mar. 5, 2014, 41 pages.
Final Written Decision filed in IPR2013-00067 on Apr. 28, 2014, 43 pages.
Exhibit 3001 filed in IPR2013-00067 on Apr. 28, 2014, 3 pages.
Exhibit 3002 filed in IPR2013-00067 on Apr. 28, 2014, 4 pages.
Notice of Appeal filed in IPR2013-00067 on Jun. 30, 2014, 5 pages.
PCT/US2009/056795, International Search Report and Written Opinion dated Apr. 20, 2010, 16 pages.
PCT/US2012/028576, International Search Report and Written Opinion dated Oct. 1, 2012, 10 pages.
PCT/US2012/028534, International Search Report and Written Opinion dated Oct. 17, 2012, 14 pages.
PCT/US2012/028559, International Search Report and Written Opinion dated Oct. 19, 2012, 9 pages.
PCT/US2012/028534, International Preliminary Report on Patentability dated Sep. 17, 2013, 8 pages.
PCT/US2012/028576, International Preliminary Report on Patentability dated Sep. 17, 2013, 7 pages.
U.S. Appl. No. 14/257,706, filed Apr. 21, 2014, Tran et al.
U.S. Appl. No. 14/257,719, filed Apr. 21, 2014, Tamm et al.
U.S. Appl. No. 14/257,737, filed Apr. 21, 2014, Tamm et al.
p. 1 of Lyden Letter dated Apr. 21, 2010, redacted.
Eberle et al., Excerpt from Clothing Technology, 2002, 3 pages.
Compendium Warp Knitting, Sonderdruck, Karl Mayer GmbH, Aug. 1, 1978, 8 pages.
Duolastic—an elastic fabric sets new standards, HKS 1 MSU E-Magazine—weft elastic tricot machine, Sonderdruck, Karl Mayer GmbH, Aug. 4, 1989, 8 pages.
Fabric Pictures, www.karlmayer.com, Karl Mayer GmbH, undated, 7 pages.
Jacquard Rashchel machine for the Production of Curtains, Karl Mayer GmbH, Jan. 12, 1996, 4 pages.
Knitting Wear—SM8 Top 1, Santoni S.p.A., undated, 2 pages.
MRSS 42 SU: for producing the finest laces with ground in 22 dtex monofilaments, Sonderdruck, Karl Mayer GmbH, Aug. 4, 1988, 3 pages.
Multibar Jacquard Raschel Machine for Lace, Net Curtains and Patterned Elastic Products, Sonderdruck, Karl Mayer GmbH, Aug. 4, 1978, 6 pages.
Decision on Appeal in U.S. Reexam Application 95/001,320, filed as Exhibit 2008 in IPR2013-00067 on Aug. 19,2013, 37 pages.
Anand et al., Technical Fabric Structures—2. Knitted Fabrics, Handbook of Technical Textiles, Woodhead Publishng, 2000, 5 pages.
Ebrlle et al., Clothing Technology, Sixth German Edition and Third English Edition, Veriag Europa-Lehrmittel, Nourney, Vollmer GmbH & Co., D-42781 Haa-Guriten, ISBN 3-8085-6223-4, Nov. 28, 2012, 3 pages.
European Patent Application No. 13161357.2, Extended European Search Report dated Aug. 5, 2013, 6 pages.
R. Shishoo, Chapter 16 of Textiles in Sport, filed as Exhibit 2004 in IPR2013-00067 on Nov. 28, 2012, 22 pages.
Decision Institution of Inter Partes Review 37 C.F.R. § 42.108 in IPR2013-00067, entered May 17, 2013, 38 pages.
Declaration and Curriculum Vitae of Dr. Edward C. Frederick, filed as Exhibit 1001 in IPR2013-00067 on Nov. 28, 2012, 178 pages.
Declaration Edward C. Frederick with note, filed as Exhibit 2002 in IPR2013-00067 on Aug. 19, 2013, 23 pages.
Declaration of Raymond Tonkel, filed as Exhibit 2010 in IPR2013-00067 on Aug. 19, 2013, 101 pages.
Edward Frederick Deposition Transcript dated Jul. 23, 2013, filed as Exhibit 2009 in IPR2013-00067 on Aug. 19, 2013, 187 pages.
Errata Sheet from Edward Frederick Deposition dated Aug. 23, 2013, filed as Exhibit 2013 in IPR2013-00067 on Aug. 29, 2013, 1 page.
Excerpts from Man-Made Fiber and Textile Dictionary, filed as Exhibit 2012 in IPR2013-00067 on Aug. 19, 2013, 4 pages.
File History for U.S. Pat. No. 7,347,011, filed as Exhibit 1003 in IPR2013-00067 on Nov. 28, 2012, 201 pages.
Hunter, Billy, viewpoint: Nike Flyknit Quantum Leap for Flat Knitting, www.knittingindustry.com, Jul. 26, 2012, filed as Exhibit 1024 in IPR2013-00067 on Nov. 12, 2013, 5 pages.
Hunter, Billy, viewpoint: Nike Flyknit Ready, Steady, Go, www.knittingindustry.com, Jul. 31, 2012, filed as Exhibit 1025 in IPR2013-00067 on Nov. 12, 2013, 5 pages.
Notice of Filing Date Accorded to Petition and Time for Filing Patent Owner Preliminary Response, entered in IPR2013-00067 on Dec. 4, 2012, 8 pages.
Order Conduct of the Proceeding, entered in IPR2013-00067 on Jun. 19, 2013, 4 pages.
Order Conduct of the Proceeding, entered in IPR2013-00067 on Aug. 2, 2013, 5 pages.
Patent Owner Corrected Certificate of Service, filed in IPR2013-00067 on Aug. 19, 2013, 3 pages.

(56) References Cited

OTHER PUBLICATIONS

Patent Owner's Motion to Amend U.S. Pat. No. 7,347,011, filed in IPR2013-00067 on Aug. 19, 2013, 19 pages.
Patent Owner's Preliminary Response to Petition, filed in IPR2013-00067 on Feb. 28, 2013, 8 pages.
Petition for Inter Partes Review Under 35 U.S.C. 311-319 and 37 CFR 42.100 et seq., filed in IPR2013-00067 on Nov. 28, 2012, 66 pages.
Petitioner's Amended Notice of Cross Examination of Raymond Tonkel, filed in IPR2013-00067 on Nov. 1, 2013, 3 pages.
Petitioner's Opposition to Patent Owner's Motion to Amend, filed in IPR2013-00067 on Nov. 12, 2013, 20 pages.
Random House Webster Dictionary Excerpts, filed as Exhibit 2012 in IPR2013-00067 on Aug. 19, 2013, 4 pages.
Revised Petition for Inter Partes Review Under 35 U.S.C. §§ 311-319 and 37 C.F.R. § 42.100, filed in IPR2013-00067 on Dec. 10, 2012, 64 pages.
Supplemental Declaration Edward C. Frederick, filed as Exhibit 1023 in IPR2013-00067on Nov. 12, 2013, 18 pages.
U.S. Pat. No. 2,147,197 with markings, filed as Exhibit 2006 in IPR2013-00067 on Aug. 19, 2013, 5 pages.
U.S. Pat. No. 4,354,318, filed as Exhibit 2003 in IPR2013-00067on Aug. 19, 2013, 6 pages.
Spencer, Knitting Technology, Woodhead Publishing Limited, 1989 and 2001, 413 pages.
Chinese Patent Application No. 2005800066703, Office Action dated Jun. 13, 2008, 17 pages.
Chinese Patent Application No. 2005800066703, Office Action dated Jul. 27, 2007, 18 pages.
Chinese Patent Application No. 2005800066703, Office Action dated Aug. 21, 2009, 19 pages.
Chinese Patent Application No. 2005800066703, Office Action issued Feb. 15, 2008, 6 pages.
Chinese Patent Application No. 2009101783949, Office Action dated May 13, 2011, 13 pages.
International Patent Application No. PCT/US2005/004776, International Search Report and Written Opinion dated May 19, 2005, 15 pages.
*Robert M. Lyden* v. *adidas America, Inc., adidas AG, adidas International Marketing B.V., the Finish Line, Inc., and Dick's Sporting Goods, Inc.,* "Original Complaint", Case No. 3:14-CV-1586 MO, United States District Court, District of Oregon, Portland Division, filed Oct. 8, 2014, 54 pages.
Freshness Magazine (Youtube Video), "The Story Behind Nike Flyknit Technology", http://web.archive.org/web/20120225004803/http://www.freshnessmag.com/2012/02/21/the-story-behind-nike-flyknit-technology-video, published on Feb. 21, 2012, 3 pages (website screenshot submitted).
Reissue U.S. Appl. No. 95/002,094, "Patent Owner's Rebuttal Brief", filed Sep. 3, 2014, 40 pages.
Reissue U.S. Appl. No. 95/002,094, "Patent Owner's Rebuttal Brief", filed Sep. 22, 2014, 25 pages.
Underwood, Jenny, "The Design of 3D Shape Knitted Preforms", Ph.D. Thesis for School of Fashion and Textile, Design and Social Context Portfolio, RMIT University, Nov. 2009, 201 pages.
European Patent Application No. 14165041.6, European Search Report dated Nov. 11, 2014 (6 pages).
"From Fiber to Fabric: Silk", Clothing and Textiles, Utah State University Cooperative Extension, http://extension.usu.edu/files/publications/factsheet/FC_Clothing&Textiles_2012-25pr.pdf.
IPR2013-00067, Excerpts from Man-Made Fiber and Textile Dictionary, Exhibit 2011, Nov. 27, 2013, 12 pages.
ISO 8117:2003(E), "Textile Machinery—Knitting Machines—Nominal diameters of circular machines", Second Edition, Feb. 15, 2003, 6 pages.
Burall, Paul, "CoID Design Awards", Design, Jun. 1969, pp. 25, 33, and 46-47.
IPR2016-00920, Petition for Inter Partes Review of U.S. Pat. No. 8,042,288 filed Apr. 19, 2016, 67 pages.
IPR2016-00920, Exhibit 1003, Declaration of Lenny M. Holden, Apr. 19, 2016, 166 pages.
IPR2016-00921, Petition for Inter Partes Review of U.S. Pat. No. 7,814,598 filed Apr. 19, 2016, 57 pages.
IPR2016-00922, Petition for Inter Partes Review of U.S. Pat. No. 8,266,749 filed Apr. 19, 2016, 67 pages.
IPR2016-00921 and IPR-00922, Exhibit 1003, Declaration of Lenny M. Holden, Apr. 19, 2016, 154 pages.
Chinese Patent Application No. 20140160706.4, Office Action dated Apr. 26, 2016, 7 pages (No English translation available. A summary of the Office Action is provided in the Transmittal Letter submitted herewith).
Petition for Inter Partes Review Under 35 U.S.C. §§ 311-319 and 37 C.F.R. § 42.100 Et Seq. with Exhibit 1003, Declaration of Lenny M. Holden, Inter Partes Review No. 2017-00263.
Petition for Inter Partes Review Under 35 U.S.C. §§ 311-319 and 37 C.F.R. § 42.100 Et Seq. with Exhibit 1003, Declaration of Lenny M. Holden, Inter Partes Review No. 2017-00264.
Office Action, Chinese Patent Application No. 201410160706.4, dated Nov. 3, 2016, 5 pages.
Office Action, Japanese Patent Application No. 2014-077437, dated Feb. 28, 2017, 5 pages.
Photograph of Adizero Prime SP Olympia, 2012.
Photograph of Adios, 2012.
Buckley et al., "New Textile Concepts for Use in Control of Body Environments", Presented at RTO HFM Symposium on "Blowing Hot and Cold: Protecting Against Climatic Extremes", Dresden, Germany, Oct. 8-10, 2001, 7 pages.
Hong et al., "The Development of 3D Shaped Knitted Fabrics for Technical Purposes on a Flat Knitting Machine", Indian Journal of Fibre & Textile Research, vol. 19, pp. 189-194, Sep. 1994, 6 pages.
Lu et al. , "The Development of the Flat-Knitted Shaped Uppers Based on Ergonomics", AUTEX Research Journal, vol. 16, No. 2, pp. 67-74, Jun. 2016, 8 pages.
Federal Circuit Case Nos. 18-1180 & 18-1181, Appellant's Reply in Support of Motion to Remand, Jun. 5, 2018, 16 pages.
Federal Circuit Case Nos. 18-1180 & 18-1181, Appellant's Motion for Remand to PTAB, May 24, 2018, 19 pages.
Federal Circuit Case Nos. 18-1180 & 18-1181, Appellee's Opposition to Motion to Remand to PTAB, Jun. 1, 2018, 21 pages.
Federal Circuit Case Nos. 18-1180 & 18-1181, Federal Circuit Decision to Remand to PTAB, Jul. 2, 2018, 4 pages.
Federal Circuit Case Nos. 18-1180 & 18-1181, Appellant's Reply Brief, May 1, 2018, 41 pages.
Federal Circuit Case Nos. 18-1180 & 18-1181, Appellee's Corrected Response Brief, Apr. 12, 2018, 75 pages.
Federal Circuit Case Nos. 18-1180 & 18-1181, Appellant's Opening Brief, Feb. 26, 2018, 79 pages.
IPR2016-00921 & IPR2016-00922, Exhibit 1013, Analyzing the Color, Design and Texture of Fabric, 8 pages.
IPR2016-00921 & IPR2016-00922, Exhibit 1014, Merriam-Webster Dictionary Definition of Impart, 11 pages.
IPR2016-00921 & IPR2016-00922, Exhibit 2004, Transcript of Deposition of Lenny Holden, 226 pages.
IPR2016-00921 & IPR2016-00922, Exhibit 3001, Random House Webster's College Dictionary Definition of Impart and Texture, 4 pages.
IPR2016-00921 & IPR2016-00922, Record of Oral Hearing, Jul. 26, 2017, 74 pages.
IPR2016-00921 & IPR2016-00922, Exhibit 1016, Adidas's Oral Hearing Demonstratives, 84 pages.
"Knitting Machine Wins Design Award—Textile Institute & Industry", EBSCO Host,Textile Institute & Industry, vol. 7, Issue 7, Jul. 1969, 3 pages.
"Polyamide 6.6 Emana Yarn", 5 pages.
Aibibu et al., "Textile Cell-free Scaffolds for in Situ Tissue Engineering Applications", Journal of Materials Science: Materials in Medicine, vol. 27, No. 3, Mar. 2016, 20 pages.
Atalay et al., "Knitted Strain Sensors: Impact of Design Parameters on Sensing Properties", Sensors, vol. 14, No. 3, 2014, 8 pages.
Atalay et al., "Textile-Based Weft Knitted Strain Sensors: Effect of Fabric Parameters on Sensor Properties, Sensors (Basel)", vol. 13, No. 8, Aug. 21, 2013, 6 pages.

(56) References Cited

OTHER PUBLICATIONS

Barton et al., Development and Evaluation of a Tool for the Assessment of Footwear Characteristics, Journal of Foot and Ankle Research, vol. 2, 2009, 13 pages.
Federal Circuit Case No. 14-1719 , Appellant's Opening Brief to Federal Circuit, Dec. 15, 2014, 47 pages.
Federal Circuit Case No. 14-1719 , Appellant's Reply Brief, May 27, 2015, 38 pages.
Federal Circuit Case No. 14-719 , Appellee's Response Brief to Federal Circuit, Apr. 10, 2015, 76 pages.
Federal Circuit Case No. 14-1719 , Federal Circuit Decision, Feb. 11, 2016, 41 pages.
Federal Circuit Case No. 14-1719 , Federal Circuit Mandate to PTAB, Apr. 4, 2016, 1 page.
Federal Circuit Case No. 14-1719 , United States Patent and Trademark Office's Solicitor's Brief to Federal Circuit, Apr. 9, 2015, 27 pages.
Hamlin , "The Hamlin Cleanroom Bootie, MO-LA Inc.", Technical Developments, vol. 18, Mar. 1993, 2 pages.
IPR2013-00067 , Excerpts from Man-Made Fiber and Textile Dictionary, Exhibit 2011, Aug. 19, 2013, 12 pages.
IPR2013-00067 , Decision on Remand, Sep. 18, 2018, 65 pages.
IPR2013-00067 , Exhibit 1027, Petitioner's Oral Hearing Demonstratives Slides, 25 pages.
IPR2013-00067 , Exhibit 3003, Email regarding Aqua Products Conference Call, 3 pages.
IPR2013-00067 , Order Conduct of Remand Proceeding, Aug. 10, 2016, 4 pages.
IPR2013-00067 , Patent Owner's Notice of Appeal, Jun. 30, 2014, 5 pages.
IPR2013-00067 , Patent Owner's Response Brief, Nov. 16, 2017, 12 pages.
IPR2013-00067 , Petitioner's Opening Brief, Nov. 6, 2017, 12 pages.
IPR2013-00067 , Petitioner's Reply Brief on Remand, Nov. 22, 2017, 6 pages.
IPR2016-00920 , Decision Denying Institution of Inter Partes Review, Oct. 20, 2016, 8 pages.
IPR2016-00921 , Petitioner's Notice of Supplemental Evidence in Response to Patent Owner's Objection to Evidence, May 12, 2017, 4 pages.
IPR2016-00921 , Decision on Institution of Inter Partes Review, Oct. 21, 2016, 24 pages.
IPR2016-00921 , Final Written Decision, Oct. 19, 2017, 49 pages.
IPR2016-00921 , Order Modifying Institution Decision and Granting Request for Additional Briefing, Aug. 24, 2018, 14 pages.
IPR2016-00921 , Patent Owner's Objection to Admissability of Evidence, Apr. 28, 2017, 4 pages.
IPR2016-00921 , Patent Owner's Response Brief, Jan. 23, 2017, 64 pages.
IPR2016-00921 , Patent Owner's Response Brief Addressing the Newly Instituted Ground, Sep. 24, 2018, 14 pages.
IPR2016-00921 , Petitioner's Brief Addressing Newly Instituted Ground, Sep. 10, 2018, 12 pages.
IPR2016-00921 , Petitioner's Notice of Appeal, Nov. 13, 2017, 4 pages.
IPR2016-00921 , Petitioner's Reply to Patent Owner Response, Apr. 21, 2017, 32 pages.
IPR2016-00922 , Decision on Institution of Inter Partes Review, Oct. 21, 2017, 24 pages.
IPR2016-00922 , Petitioner's Notice of Supplemental Evidence in Response to Patent Owner's Objections to Evidence 37 C.F.R. § 42.64(B)(1), May 12, 2017, 4 pages.
IPR2016-00922 , Final Written Decision, Oct. 19, 2017, 52 pages.
IPR2016-00922 , Order Modifying Institution Decision and Granting for Additional Briefing, Aug. 24, 2018, 14 pages.
IPR2016-00922 , Patent Owner's Objection to Admissability of Evidence, Apr. 28, 2017, 4 pages.
IPR2016-00922 , Patent Owner's Response Brief, Jan. 23, 2017, 66 pages.
IPR2016-00922 , Patent Owner's Response Brief Addressing Newly Instituted Ground, Sep. 24, 2018, 14 pages.
IPR2016-00922 , Petitioner's Brief Addressing Newly Instituted Ground, Sep. 10, 2018, 12 pages.
IPR2016-00922 , Petitioner's Notice of Appeal, Nov. 13, 2017, 4 pages.
IPR2016-00922 , Petitioner's Reply Brief, Apr. 21, 2017, 34 pages.
IPR2017-00263 , Decision Denying Institution of Inter Partes Review, Jun. 7, 2017, 11 pages.
IPR2017-00263 , Decision Denying Request for Rehearing, Jul. 20, 2017, 12 pages.
IPR2017-00263 , Patent Owner's Corrected Preliminary Response, Mar. 27, 2017, 24 pages.
IPR2017-00263 , Patent Owner's Preliminary Response, Mar. 9, 2017, 24 pages.
IPR2017-00263 , Petitioner's Request for Rehearing, Jul. 7, 2017, 17 pages.
IPR2017-00264 , Decision Denying Institution of Inter Partes Review, Jun. 7, 2017, 12 pages.
IPR2017-00264 , Decision Denying Request for Rehearing, Jul. 20, 2017, 12 pages.
IPR2017-00264 , Patent Owner's Corrected Preliminary Response, Mar. 27, 2017, 24 pages.
IPR2017-00264 , Patent Owner's Preliminary Response, Mar. 9, 2017, 24 pages.
IPR2017-00264 , Petitioner's Request for Rehearing, Jul. 7, 2017, 17 pages.
Lo et al., "Effects of Custom-Made Textile Insoles on Plantar Pressure Distribution and Lower Limb Emg Activity During Turning", Journal of Foot and Ankle Research, vol. 9, Jul. 13, 2016, 11 pages.
Office Action, German Patent Application No. 102013207155.8, dated Aug. 10, 2017, 6 pages. (See IDS Transmittal).
Office Action , Japanese Patent Application No. 2014-077437, dated Jan. 9, 2018, 7 pages.
Saenz-Cogollo et al., "Pressure Mapping Mat for Tele-Home Care Applications", Sensors, vol. 16, No. 3, E365, Mar. 11, 2016, 9 pages.
Singh et al., "Medical Textiles as Vascular Implants and Their Success to Mimic Natural Arteries", Journal of functional biomaterials, vol. 6, No. 3, Sep. 2015, 15 pages.
Stoppa et al., "Wearable Electronics and Smart Textiles: A Critical Review", Sensors, vol. 14, No. 7, 2014, 20 pages.
U.S. Appl. No. 14/257,719 , Final Office Action, dated Jan. 24, 2019, 15 pages.
U.S. Appl. No. 14/257,737 , Final Office Action, dated Jan. 2, 2019, 15 pages.
U.S. Appl. No. 14/619,586 , Non-Final Office Action, dated Jan. 14, 2019, 10 pages.
FC19-1262, Reply Brief of Appellant Nike, Inc., Sep. 13, 2019, 38 pages.
FC19-1262, Appellee Adidas AG's Response Brief, Aug. 9, 2019, 60 pages.
IPR 19-1787, Appellant Adidas AG's Opening Brief, Aug. 30, 2019, 319 pages.
Notice of Opposition, European Patent Application No. 13161357.2, dated Apr. 1, 2019, 49 pages.
Office Action, German Patent Application No. 10 2013 207 155.8, dated Jul. 15, 2019.
Petitioner Adidas AG's Notice of Appeal, IPR2016-00921, Apr. 19, 2019, pp. 1-71.
Principal Brief of Appellant Nike, Inc., United States Court of Appeals for the Federal Circuit, Appeal from the United States Patent and Trademark Office Patent Trial and Appeal Board Case No. IPR2013-00067, May 17, 2019, pp. 1-59.
Eberle et al., Clothing Technology, Third English Edition, 2002, 291 pages.
IPR2013-00067 , Nike's Notice of Appeal, Nov. 20, 2018, 69 pages.
IPR2016-00921 , Decision on Remand—35 USC 144 and 37 CFR 42.5(a), Feb. 19, 2019, pp. 1-67.
IPR2016-00921-00922 , Hearing Transcript, Nov. 29, 2018, 37 pages.

(56) References Cited

OTHER PUBLICATIONS

IPR2016-00921-00922 , Nike's Demonstratives for Additional Oral Hearing, Nov. 15, 2018, pp. 1-21.
IPR2016-00921-00922 , Patent Owner Nike's Demonstratives, Jul. 11, 2017, pp. 1-27.
IPR2016-00921-00922 , Petitioner's Demonstratives for Supplemental Oral Hearing, Nov. 15, 2018, pp. 1-21.
IPR2016-00921-00922 , Record of Oral Hearing, Nov. 15, 2018, 37 pages.
IPR2016-00921-00922 , Transcript of Proceedings, Oct. 15, 2018, pp. 1-44.
IPR2016-00922 , Decision on Remand—35 USC 144 and 37 CFR42.5(a), Feb. 19, 2019, 71 pages.
IPR2016-00922 , Petitioner Adidas AG's Notice of Appeal, Apr. 19, 2019, 75 pages.
Federal Circuit Case No. 19-1787, Appellee Nike, Inc.'s Response Brief, Nov. 25, 2019, 77 pages.
Federal Circuit Case No. 19-1787, Reply Brief for Appellant Adidas AG, Dec. 23, 2019, 40 pages.
Federal Circuit Case No. 1-1787, Joint Appendix, Dec. 30, 2019, 582 pages.
Federal Circuit Case No. 19-1787, Appellant Adidas Citation of Supplemental Authority, May 15, 2020, 31 pages.
Federal Circuit Case No. 19-1987, Appellee Nike Response to Citation of Supplemental Authority, May 20, 2020, 3 pages.
Decision on Appeal, Federal Circuit Case No. 19-1262, Apr. 9, 2020, 17 pages.
Federal Circuit Case No. 2019-1262, Appellant's Citation of Supplemental Authority Pursuant to Rule 28(j), Jan. 29, 2020, 11 pages.
Judgment, Federal Circuit Case No. 19-1262, Apr. 9, 2020, 1 page.
Chamberlain, "Knitted Fabrics", 1919, pp. 80-103, Sir Isaac Pitman & Sons, Ltd., London.
Chamberlain, "Principles of Machine Knitting", 1951, pp. 54-57, The Textile Institute, Manchester.
Wignall , "Knitting", 1964, pp. 99-101, 116-129, Pitman Publishing, London.
Office Action, Chinese Patent Application No. 201410160706.4, dated Jul. 3, 2015, 11 pages.
Office Action, Chinese Patent Application No. 201410160706.4, dated May 3, 2017 12 pages.
Office Action, Chinese Patent Application No. 201410160706.4, dated Jun. 6, 2018, 8 pages.
Office Action, Chinese Patent Application No. 201410160706.4, dated Feb. 26, 2019, 14 pages.
Office Action, German Patent Application No. 102013207155.8, dated Mar. 13, 2014, 11 pages.
Office Action, European Patent Application No. 14165041.6, dated Jul. 5, 2018, 6 pages.
Summons to Attend Oral Hearing, European Patent Application No. 14165041.6, Jul. 2, 2019, 8 pages.
Federal Circuit Case Nos. 19-1787 and 19-1788, Opinion, Jun. 25, 2020, 8 pages.
IPR Case No. 2013-00067, Exhibit 2024, Intervenor's Petition for Panel Hearing, Appeal No. 2015-1928, Aug. 20, 2020, 38 pages.
IPR Case No. 2013-00067, Patent Owner's Opening Brief on Second Remand, Aug. 20, 2020, 12 pages.
IPR Case No. 2013-00067, Patent Owner's Reply Brief on Second Remand, Sep. 3, 202, 7 pages.
IPR Case No. 2013-00067, Petitioner's Opening Brief on Remand, Aug. 20, 2020, 12 pages.
IPR Case No. 2013-00067, Petitioner's Response Brief on Remand, Sep. 3, 2020, 7 pages.
IPR Case No. 2013-00067, Order—Conduct of the Proceeding on Remand, Jul. 24, 2020, 6 pages.
European Extended Search Report, European Patent Application No. 20177836.2, dated Oct. 29, 2020, 5 pages.

* cited by examiner

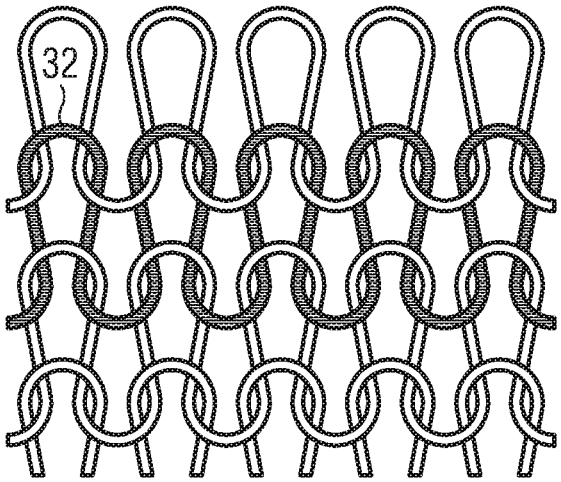
Fig. 3a
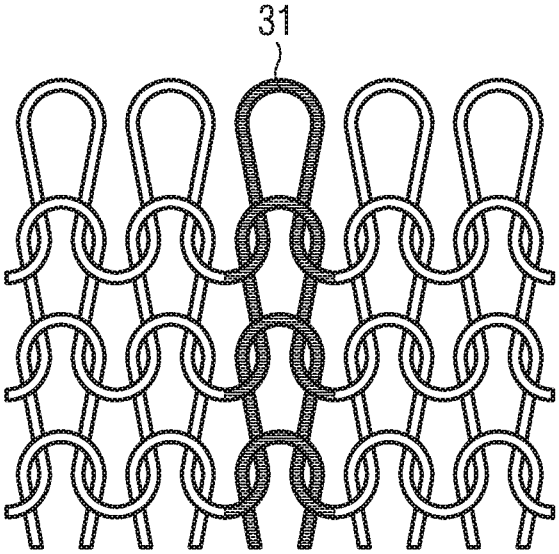
Fig. 3b
Fig. 4
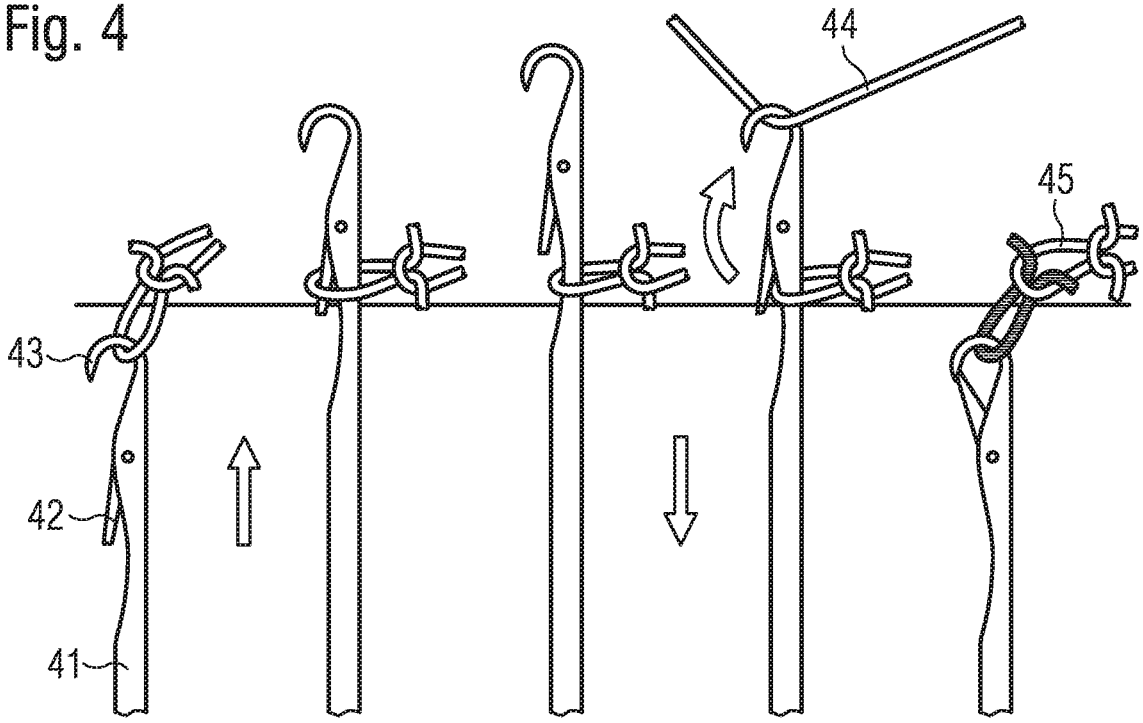

710

711

712

713

714

720

721

722

723

724

730

731

732

733

734

KNITTED SHOE UPPER

CROSS REFERENCE TO RELATED APPLICATION

This application is related to and claims priority benefits from German Patent Application No. DE 10 2013 207 155.8, filed on Apr. 19, 2013, entitled UPPER ("the '155 application"). The '155 application is hereby incorporated herein in its entirety by this reference.

FIELD OF THE INVENTION

The present invention relates to an upper for a shoe, in particular a sports shoe.

BACKGROUND

Shoes, particularly sports shoes usually comprise an upper and a sole secured to that. In this regard, the sole usually comprises a midsole and an outer sole. The upper is to surround the foot of the person wearing it as tightly as possible and, together with the sole, to ensure the best possible force transmission between the foot and the ground. At the same time, the upper and the entire shoe should be as comfortable to wear as possible without overly constraining the foot. Shoes that are too hard or too tight are perceived as unpleasant. Shoes frequently comprise lacing or a hook and loop fastener, for example, through which the upper and the entire shoe may be fixed to the foot with the desired tightness.

Use of lacing or a hook and loop fastener may create pressure that is not evenly distributed along the foot, which may result in pressure sores. Frequently, e.g. only a rather small portion of the bridge of the foot is surrounded very tightly, whereas other parts of the upper are rather loose. Small areas of the foot being tightly surrounded or constrained is perceived as unpleasant, and may limit blood circulation and result in blistering.

It is indeed also possible for a shoe to be loosely tied or fastened by a hook and loop fastener. However, especially in case of sports activities, this loose fastening has a disadvantageous effect, since force transmission from the foot to the ground is affected. Thus, it frequently happens in case of loosely tied shoes that the foot shifts relative to the sole when the person wearing the shoe speeds up, slows down, or turns. Moreover, there is a danger of the person wearing it twisting their ankle and injuring themselves in the process.

Even a shoe that is perceived as pleasant and fitting in the resting state, e.g. when standing, may exert unpleasant pressure on the foot during walking or running. This result may be caused by the fact that the upper does not correctly track the foot's movement of rolling over.

Finally, for economic reasons, shoes are only manufactured in a certain number of sizes and shapes of cobbler's lasts. The shoe size of a person purchasing a shoe may possibly be between two prescribed shoe sizes or shapes of cobbler's lasts. A shoe of the next bigger shoe size would then be too large for them, whereas a shoe of the next smaller shoe size would be too small. Individually adjusting the shoe or even having one made to measure would involve high costs.

Therefore, it is the object of the present invention to provide an upper that removes or at least reduces the described disadvantages of the prior art while being easy and cost-effective to produce. It is a further object to provide a corresponding shoe and specify a method for producing a corresponding upper.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, an upper for a shoe comprises at least one first partial area and at least one second partial area that are manufactured as one-piece knitwear, wherein the at least one first partial area comprises a first yarn and the at least one second partial area comprises a second yarn, and wherein the first yarn is more elastic than the second yarn.

In some embodiments, the at least one first partial area and the at least one second partial area are arranged such that the at least one first partial area is configured to be stretched more than the at least one second partial area when the shoe is worn.

In certain embodiments, the one-piece knitwear is weft-knitted. In other embodiments, the one-piece knitwear is warp-knitted.

In some embodiments, the at least one first partial area and the at least one second partial area may run substantially parallel to one another. In other embodiments, the at least one first partial area and the at least one second partial area may run substantially orthogonal to a longitudinal axis of the shoe. In additional embodiments, the at least one first partial area and the least one second partial area may run substantially parallel to one another. In other embodiments, the at least one first partial area and the at least one second partial area may be arranged on one or more of a lateral side and a medial side of a midfoot area of the upper.

In certain embodiments, the at least one first partial area is arranged in an ankle area or in an instep area of the upper.

In further embodiments, the at least one first partial area and the at least one second partial area are arranged substantially symmetrically around a longitudinal axis of the upper.

In some embodiments, the first yarn comprises elastane or rubber.

In certain embodiments, the one-piece knitwear further comprises a monofilament. In further embodiments, the one-piece knitwear further comprises a melt yarn.

In some embodiments, one or both of the at least one first partial area and the at least one second partial area are weft-knitted in intarsia or Jacquard technique.

In some embodiments, the upper surrounds a foot of a wearer at least partially and wherein one or both of the at least one first partial area and the at least one second partial area are at least partially arranged in an area of a sole below the foot of the wearer.

According to certain embodiments of the present invention, a shoe comprises an upper for a shoe comprises at least one first partial area and at least one second partial area that are manufactured as one-piece knitwear, wherein the at least one first partial area comprises a first yarn and the at least one second partial area comprises a second yarn, and wherein the first yarn is more elastic than the second yarn.

According to certain embodiments of the present invention, an upper for a shoe comprises at least one first partial area and at least one second partial area that are manufactured as one-piece knitwear, wherein the at least one first partial area comprises a first yarn and the at least one second partial area comprises a second yarn, wherein the first yarn is more elastic than the second yarn, and the upper surrounds a foot of a wearer at least partially and wherein the at least one first partial area and the at least one second partial area are at least partially arranged in an area of a sole below the foot of the wearer.

In some embodiments, one or both of the at least one first partial area and the at least one second partial area are weft-knitted in intarsia or Jacquard technique.

According to certain embodiments, one or both of the at least one first partial area and the at least one second partial area are at least partially arranged on one or both of a lateral side and a medial side of a midfoot area of the upper. In some embodiments, at least one first partial area and the at least one second partial area are at least partially arranged substantially symmetrically around a longitudinal axis of the upper.

According to certain embodiments of the present invention, a method of manufacturing an upper comprises at least one first partial area and at least one second partial area that are manufactured as one-piece knitwear, wherein the at least one first partial area comprises a first yarn and the at least one second partial area comprises a second yarn, and wherein the first yarn is more elastic than the second yarn, the method comprising manufacturing the at least one first partial area and the at least one second partial area as the one-piece knitwear.

BRIEF DESCRIPTION OF THE DRAWINGS

In the following detailed description, embodiments of the invention are described referring to the following figures:

FIGS. 3*a*-3*b* are schematic representations of weft-knitted fabrics, according to certain embodiments of the present invention.

FIG. 4 are illustrations showing a process of stitch forming by latch needles during weft-knitting, according to certain embodiments of the present invention.

BRIEF DESCRIPTION

Figure 1A:
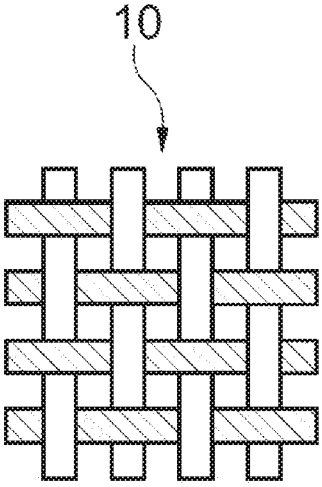
FIGS. 1*a*-1*d* are schematic representations of textile structures, according to certain embodiments of the present invention.
Figure 1B:
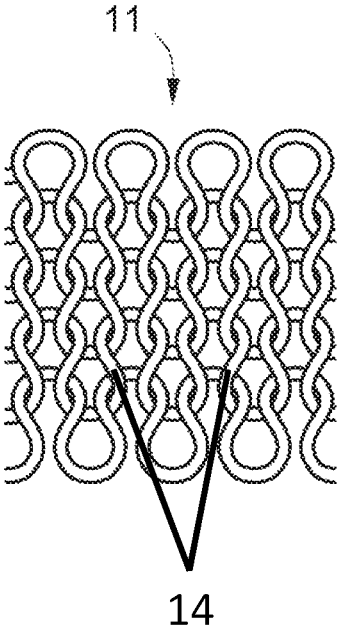
Figure 1C:
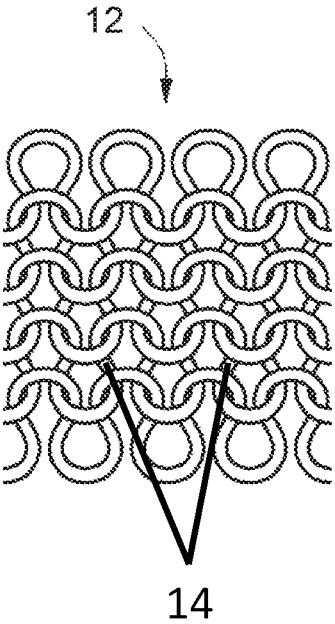
Figure 1D:
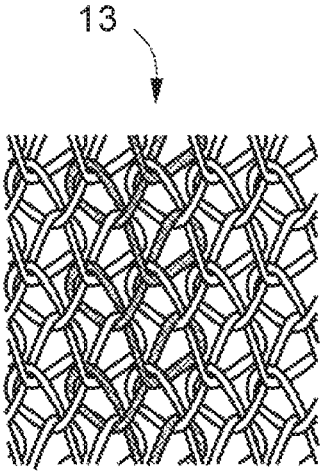

According to certain embodiments of the present invention, a shoe upper for a shoe comprises at least one first partial area and at least one second partial area, which are manufactured as one-piece knitwear, wherein the first partial area comprises a first yarn and the second partial area comprises a second yarn, and wherein the first yarn is more elastic than the second yarn.

Due to the fact first partial area comprises a more elastic yarn, the upper may adjust to the shape of the foot. The pressure on the foot necessary for a good fit is distributed over the surface of the foot by the second partial area, so that pressure sores are avoided. The wear comfort of the shoe as a whole is increased. Moreover, especially in sports shoes, a tightly fitting shoe improves so-called proprioception, i.e. it supports the motion sequence by perceivable feedback to the athlete.

At the same time, the less elastic yarn in the second area causes the upper to be stable on the whole and the foot to be better able to transmit the forces occurring in case of extreme force being exerted, e.g. when speeding up or slowing down, to the ground via the shoe. The second partial area furthermore prevents or reduces shifting of the shoe relative to the sole during high accelerations.

Since the first and the second partial areas are formed as one-piece knitwear, both partial areas are able to interact in an optimum manner and exerted forces may be directly transmitted between the two partial areas. Since seams are furthermore done without, they may neither tear nor be perceived as irritating by the wearer of the shoe. Moreover, the upper is easy and cost-effective to produce, since separately cutting the first and the second partial areas to size and subsequently assembling them may be done without.

The manufacture of both partial areas in one piece may be effected on a weft-knitting or warp-knitting machine, for example, as will be explained in detail below. One or more of the first partial area and the second partial area may comprise connected or unconnected sections, i.e. a partial area does not have to be a contiguous surface. A partial area may e.g. also be composed of two portions which are not adjacent to each other.

Elasticity of the yarn may be measured by a tensile strain being applied to the yarn and the resulting change in length being measured, for example. Elasticity may be specified as Young's modulus, for example. Young's modulus is the quotient of the tensile strain and the resulting elongation, with the elongation specifying the ratio of the change in length to the original length. Young's modulus may be specified as Newton per square meter ($N/m^2$), for example. Thus, a more elastic yarn has a lower Young's modulus than a less elastic yarn.

The different Young's moduli of the first and the second yarn result in different Young's moduli of the first and the second partial areas. For example, the first partial area may comprise a Young's modulus of 0.6 MPa whereas the second partial area may comprise a Young's modulus of 1.88 MPa.

The first partial area and the second partial areas may be arranged such that during wearing of the shoe the first partial area is stretched more than the second partial area. Due to this arrangement, the upper yields in the areas in which it is subject to particularly great stretching during wear. Accordingly, the pressure exerted on the foot is lower than with a conventional upper in these areas. It is e.g. known that increased stretching of the foot occurs when walking barefoot in the rolling-over area between the toe bones and the midfoot area, both medially and laterally. However, only slight extensions occur in the area of the ankle, for example. Accordingly, the first partial area might be located in the rolling-over area between the toe bones and the midfoot area, whereas the second partial area could be arranged in the area of the ankle (also referred to as collar area).

In certain embodiments, the knitwear is weft-knitted. Knitwear may be produced on a weft-knitting machine. A weft-knitting machine may relatively easily provide the knitwear with structures. For example, a weft-knitted fabric may be provided with various weft-knitting structures or weft-knitting patterns in various areas on a weft-knitting machine. In some embodiments, the knitwear is flat weft-knitted. In flat weft-knitting, a certain yarn, e.g. an elastic yarn, may be used in certain, but arbitrary, areas in the weft-knitted fabric.

In additional embodiments, the knitwear is warp-knitted. Knitwear may be cost-effectively and quickly manufactured on a warp-knitting machine.

In some embodiments, the first partial area and the second partial area run substantially parallel. Due to the parallel run, the functions of both areas are complementary. While, due to the elastic yarn, the first partial area ensures that the upper adjusts itself to the shape of the foot, the second partial area, due to its less elastic yarn, causes an optimum force transmission of the foot and thus prevents or reduces shifting of the foot relative to a sole.

In some embodiments, the first and second partial areas run substantially orthogonal to a longitudinal axis of the shoe. This tightly surrounds the foot and laterally exerted forces are diverted through the second partial area. Moreover, this arrangement enables adjustment in size of the shoe in the longitudinal direction.

In some embodiments, the first and second partial areas are arranged on one or more of a lateral and a medial side of the midfoot area of the upper. Especially the midfoot area is important for a good fit and force transmission. Due to the arrangement of the first partial area and/or the second partial area on one or more of a lateral side and a medial side, the foot is stabilized in case of forces being exerted on the sides, as occur in tennis, for example.

On principle, the arrangement of the first partial area and the second partial area may vary depending on the type of sport. In types of sports with predominantly lateral stresses, such as tennis, the second partial area, which comprises the second, less elastic yarn, may be arranged mainly in the lateral area. This results in an asymmetrical distribution of the first and the second partial area. In types of sports with predominantly linear stresses, such as running, the first and the second area may be arranged rather symmetrically.

In some embodiments, the first partial area is arranged in the ankle area (also referred to as collar area) of the upper. Alternatively or additionally, the first partial area is arranged in the instep area of the upper. In these areas, unpleasant pressure sores frequently occur. This may be counteracted due to the arrangement of the first partial area with the elastic yarn in these areas. The arrangement in the first partial area in the ankle region also facilitates putting the shoe on. Moreover, the upper may adapt to various instep heights. Lacing could be done without.

In some embodiments, the first partial area and the second partial area are arranged substantially symmetrically around a longitudinal axis of the upper. A symmetrical arrangement of the two partial areas ensures an even distribution of pressure on the foot.

In some embodiments, the first yarn comprises elastane or rubber. Both materials are of high ductility, so that the upper is able to exert the necessary pressure on the foot and the upper is able to adjust itself to different sizes of feet. It would be conceivable, for example, that a size of the upper covers a range of sizes of feet, so that it is not necessary to produce uppers for all sizes of feet. Certain intermediate sizes would be omitted, so that storage costs would be reduced.

The knitwear may further comprise a monofilament. The knitwear may be additionally reinforced and given stability in specific places by a monofilament. In certain embodiments, the second partial area comprises a monofilament. This achieves higher stability, which may be beneficial in the heel area, the toe area, and/or the lateral midfoot area.

According to certain embodiments, the knitwear further comprises a melting yarn. A melting yarn may be fused by heating. The melting yarn hardens when it is subsequently cooled down. In this way, the knitwear may be specifically stiffened. In some embodiments, the second partial area comprises a melt yarn. This achieves higher stability. This may be beneficial in the heel area, the toe area, and/or the lateral midfoot area.

In certain embodiments of the present invention, one or more of the first partial area and the second partial area are weft-knitted in intarsia or Jacquard technique. Intarsia or Jacquard technique allow it in a simple manner to manufacture neighboring partial areas with different yarns when weft-knitting or warp-knitting knitwear.

In some embodiments, the upper surrounds the foot of a person wearing it at least partially and one or more of the first partial area and the second partial area are at least partially arranged in the area of the sole. Due to this arrangement, the upper closely fits the foot and provides high stability also in the area of the sole. The upper matches the foot in an ideal manner along its entire circumference. For example, in case of shoes of a moccasin construction, the upper surrounds the foot of the wearer only partially, that is, on the forefoot area. In other shoe constructions, the upper may fully surround the foot.

According to further embodiments of the present invention, a shoe, particularly a sports shoe, comprises an upper described above.

According to yet other embodiments of the present invention, a method of producing an upper described above comprises the step of manufacturing at least one first partial area and at least one second partial area as one-piece knitwear.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, embodiments and variations of the present invention are described in more detail on the basis of an upper for a shoe, in particular a sports shoe.

The use of knitwear allows products such as an upper or a sole of a shoe, such as an insole, strobel sole, midsole and/or outer sole to be equipped with areas having different characteristics and providing different functions with low production effort. The properties include bendability, stretchability (expressed as Young's modulus, for example), permeability to air and water, thermoconductivity, thermal capacity, moisture absorption, static friction, abrasion resistance, hardness, and thickness, for example.

Various techniques are applied in order to achieve such characteristics or functions, which will be described in the following. Such suitable techniques in manufacturing knitwear include knitting techniques, the selection of fibers and yarns, coating the fibers, yarns or knitwear with polymer or other materials, the use of monofilaments, the combination of monofilaments and polymer coating, the application of fuse/melt yarns, and multi-layer textile material. In general, the yarns used for the manufacture of knitwear may be equipped, i.e. coated accordingly. In addition or alternatively, the finished knitwear may be equipped accordingly.

Another aspect of providing functions concerns the specific use of knitwear for certain areas of a product, for example of an upper or a sole, and the connection of different parts by suitable connection techniques. The mentioned aspects and techniques as well as other aspects and techniques will be explained in the following.

The described techniques may be used individually or they may be combined in any manner.

Knitwear

Knitwear used in the present invention is divided into weft-knitted fabrics and single-thread warp-knitted fabrics on the one hand and multi-thread warp-knitted fabrics on the other hand. The distinctive characteristic of knitwear is that it is formed of interlocking yarn or thread loops. These thread loops are also referred to as stitches and may be formed of one or several yarns or threads.

Yarn or thread are terms for a structure of one or several fibers which is long in relation to its diameter. A fiber is a flexible structure which is rather thin in relation to its length. Very long fibers, of virtually unlimited length with regard to their use, are referred to as filaments. Monofilaments are yarns formed of one single filament, that is, one single fiber.

In weft-knitted fabrics and single-thread warp-knitted fabrics, the stitch formation requires at least one thread or yarn, with the thread running in longitudinal direction of the product, i.e. substantially at a right angle to the direction in which the product is made during the manufacturing process. In multi-thread warp-knitted fabrics, the stitch formation requires at least one warp sheet, i.e. a plurality of so-called warps. These stitch-forming threads run in longitudinal direction, i.e. substantially in the direction in which the product is made during the manufacturing process.

FIGS. 1*a*-1*d* show the basic difference between a woven fabric 10, weft-knitted fabrics 11 and 12, and a warp-knitted fabric 13. A woven fabric 10 has at least two thread sheets that are usually arranged at a right angle to one another. In this regard, the threads are placed above or underneath each other and do not form stitches. Weft-knitted fabrics 11 and 12 are created by knitting with one thread from the left to the right by interlocking stitches. View 11 shows a front view (also referred to as the front loop fabric side) and view 12 a back view (also referred to as the back loop fabric side) of a weft-knitted fabric 11, 12. The front loop and back loop product sides differ in the run of the legs 14. On the back loop fabric side 12, the legs 14 are covered in contrast to the front loop fabric side 11.

Figure 1E:
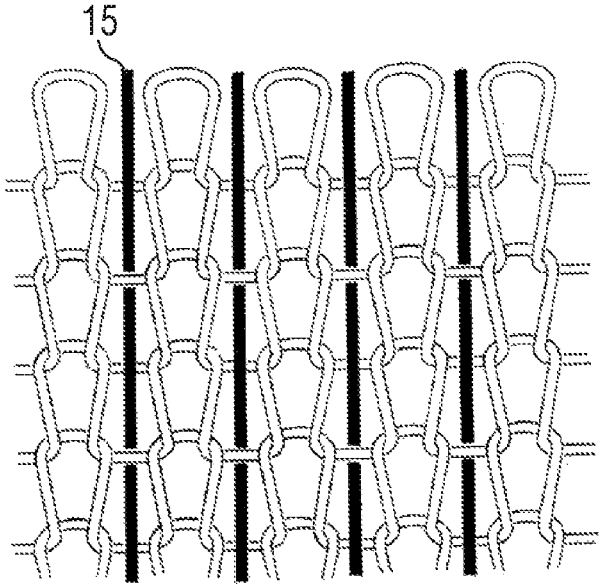
FIG. 1*e* is a schematic representation of a weft-knitted fabric with a filler yarn, according to certain embodiments of the present invention.

Certain embodiments of a weft-knitted fabric that may be used for the present invention with a filler yarn 15 is shown in FIG. 1*e*. A filler yarn 15 is a length of a thread placed between two wales in longitudinal direction, which is held by transverse threads of other weave elements. By the combination of the filler yarn 15 with other weave elements, the properties of the weft-knitted fabric are influenced or various pattern effects are achieved. Stretchability of the weft-knitted fabric in the direction of the wales may for example be reduced by a filler yarn 15.

Multi-thread warp-knitted fabric 13 is created by warp-knitting with many threads from top down, as shown in FIGS. 1*a*-1*d*. In doing so, the stitches of a thread are interlocked with the stitches of the neighboring threads. Depending on the pattern according to which the stitches of the neighboring threads are interlocked, one of the seven basic connections (also referred to as "interlaces" in multi-thread warp-knitting) pillar, tricot, 2×1 plain, satin, velvet, atlas and twill are created, for example.

Figure 2A:
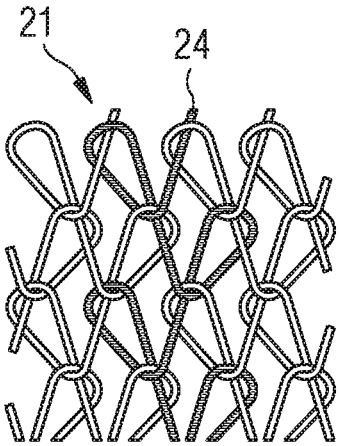
FIGS. 2*a*-2*c* are schematic representations of various interlaces of a warp-knitted fabric, according to certain embodiments of the present invention.
Figure 2B:
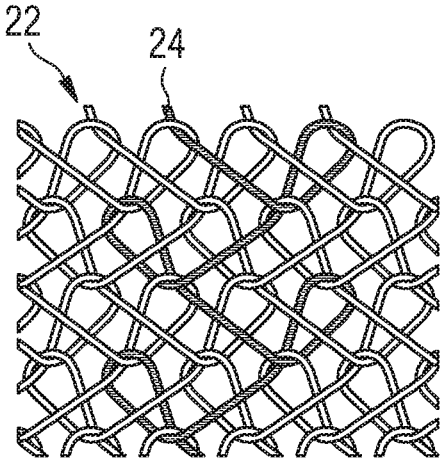
Figure 2C:
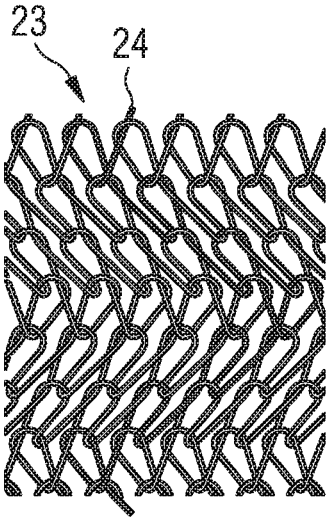

By way of example, the interlaces tricot 21, 2×1 plain 22, and atlas 23 are shown in FIGS. 2*a*-2*c*. A different interlocking results depending on how the stitches of thread 24, which is highlighted by way of example, are interlocked in the stitches of neighboring threads. In the tricot interlace 21, the stitch-forming thread zigzags through the knitwear in the longitudinal direction and binds between two neighboring wales. The 2×1 plain interlace 22 binds in a manner similar to that of the tricot interlace 21, but each stitch-forming warp skips a wale. In the atlas interlace 23, each stitch-forming warp runs to a turning point in a stairs-shape and then changes direction.

Stitches arranged above each other with joint binding sites are referred to as wales. FIGS. 3*a*-3*b* show a wale as an example of a weft-knitted fabric 31. The term wale is also used analogously in warp-knitted fabrics. Accordingly, wales run vertically through the mesh fabric. Rows of stitches arranged next to one another, as shown by way of example for a weft-knitted fabric 32 in FIGS. 3*a*-3*b* are referred to as courses. The term course is also used analogously in warp-knitted fabrics. Accordingly, courses run through the mesh fabric in the lateral direction.

Three basic weft-knitted structures are known in weft-knitted fabrics, which may be recognized by the run of the stitches along a wale. With plain, single Jersey, only back loops may be recognized along a wale on one side of the fabric and only back loops may be recognized along the other side of the product. This structure is created on one row of needles of a knitting machine, i.e. an arrangement of neighboring knitting needles, and also referred to as single Jersey. With rib fabric, front and back loops alternate within a course, i.e. either only front or back loops may be found along a wale, depending on the side of the product from which the wale is considered. This structure is created on two rows of needles with needles offset opposite each other. With purl fabric, front and back loops alternate in one wale. Both sides of the product look the same. This structure is manufactured using latch needles as illustrated in FIG. 4 by stitch transfer. The transfer of stitches may be avoided if double latch needles are used, which comprise both a hook and a latch at each end.

In many embodiments, a variety of structures and surfaces that may be created with knitwear, which may or may not also be possible with weaving. It is possible to manufacture both very heavy and/or stiff knitwear and very soft, transparent and/or stretchable knitwear with substantially the same manufacturing technique. The parameters by which the properties of the material may be influenced substantially are the pattern of weft-knitting or warp-knitting, the used yarn, the needle size or the needle distance, and the tensile strain subject to which the yarn is placed on the needles.

In certain embodiments of weft-knitting, yarns may be weft-knitted in at freely selectable places. In this manner, selected zones may be provided with certain properties. For example, an upper for a soccer shoe may be provided with zones made from rubberized yarn in order to achieve higher static friction and thus enable the player to better control the ball. With certain yarns being weft-knitted in at selected places, no additional elements have to be applied.

Knitwear is manufactured on machines in the industrial context. These machines usually comprise a plurality of needles. In weft-knitting, latch needles 41 are usually used, which may comprise a moveable latch 42, as illustrated in FIG. 4. This latch 42 closes the hook 43 of the needle 41 so that a thread 44 may be pulled through a stitch 45 without the needle 41 being caught on the stitch 45. In weft-knitting, the latch needles 41 are usually moveable individually, so that every single needle 41 may be controlled so that it catches a thread for stitch formation.

A differentiation is made between flat-knitting and circular-knitting machines. In flat-knitting machines, a thread feeder feeds the thread back and forth along a row of needles. In a circular-knitting machine, the needles are arranged in a circular manner and the thread feeding correspondingly takes place in a circular movement along one or more round rows of needles.

Instead of a single row of needles, it is also possible for a knitting machine to comprise two parallel rows of needles. When looked at from the side, the needles of the two rows of needles may, for example, be opposite each other at a right angle. This enables the manufacture of more elaborate structures or weaves. The use of two rows of needles allows the manufacture of a one-layered or two-layered weft-knitted fabric. A one-layered weft-knitted fabric is created when the stitches generated on the first row of needles are enmeshed with the stitches generated on the second row of needles. Accordingly, a two-layered weft-knitted fabric is created when the stitches generate on the first row of needles are not or only selectively enmeshed with the stitches generated on the second row of needles and/or if they are merely enmeshed at the end of the weft-knitted fabric. If the stitches generated on the first row of needles are loosely enmeshed only selectively with the stitches generated on the second row of needles by an additional yarn, this is also referred to as spacer weft-knitted fabric. The additional yarn, for example a monofilament, is thus guided back and forth between two layers, so that a distance between the two layers is created. The two layers may e.g. be connected to each other via a so-called tuck stitch.

Generally, the following weft-knitted fabrics may thus be manufactured on a weft-knitting machine: If only one row of needles is used, a one-layered weft-knitted fabric may be created. When two rows of needles are used, the stitches of both rows of needles may consistently be connected to each other so that the resulting knitwear comprises a single layer. If the stitches of both rows of needles are not connected or only connected at the edge when two rows of needles are used or are only selectively connected in certain locations, two layers are created. If the stitches of both rows of needles are connected selectively in turns by an additional thread, a spacer weft-knitted fabric is created. The additional thread is also referred to as spacer thread and it may be fed via a separate yarn feeder.

In certain embodiments, single-thread warp-knitted fabrics may be manufactured by jointly moved needles. In other embodiments, single-thread warp-knitted fabrics needles may be manufactured by fixing the needles and moving the fabric to create the relative motion between the needles and the fabric. In contrast to weft-knitting, the needles are typically not moved individually. Similar to weft-knitting, there are flat single thread warp-knitting and circular single thread warp-knitting machines.

In multi-thread warp-knitting, one or several coiled threads, i.e. threads which are coiled next to one another, are used. In stitch formation, the individual warps are placed around the needles and the needles are moved jointly.

The techniques described herein as well as further aspects of the manufacture of knitwear may be found in "Fachwissen Bekleidung", 6th ed. by H. Eberle et al. (published with the title "Clothing Technology" in English), in "Textil- and Modelexikon", 6th ed. by Alfons Hofer and in "Maschenlexikon", 11th ed. by Walter Holthaus, for example.

Three-Dimensional Knitwear

Three-dimensional (3D) knitwear may also be manufactured on weft-knitting machines and warp-knitting machines, particularly on flat-knitting machines. This is knitwear comprises a spatial structure although it is weft-knitted or warp-knitted in a single process. A three-dimensional weft-knitting or warp-knitting technique allows for spatial knitwear to be manufactured without seams, cut or manufacture in one piece and in a single process.

Three-dimensional knitwear may, for example, be manufactured by varying the number of stitches in the direction of the wales by partial courses being formed. The corresponding mechanical process is referred to as "needle parking". Depending on the requirement, this technique may be combined with structural variations and/or variations of the number of stitches in the direction of the course. When partial courses are formed, stitch formation temporarily occurs only along a partial width of the weft-knitted fabric or warp-knitted fabric. The needles which are not involved in the stitch formation keep the half stitches ("needle parking") until weft-knitting occurs again at this position. In this way, it is possible to form bulges, for example.

By three-dimensional weft-knitting or warp-knitting, an upper may be adjusted to the cobbler's last or the foot and a sole may be profiled, for example. The tongue of a shoe may e.g. be weft-knitted into the right shape. Contours, structures, knobs, curvatures, notches, openings, fasteners, loops and pockets may be integrated into the knitwear in a single process.

Three-dimensional knitwear may be used for the present invention in an advantageous manner.

Functional Knitwear

According to certain embodiments of the present invention, knitwear and particularly weft-knitted fabric may be provided with a range of functional properties and used in the present invention.

It is possible using a weft-knitting technique to manufacture knitwear having different functional areas and simultaneously maintaining its contours. The structures of knitwear may be adjusted to functional requirements in certain areas, by the stitch pattern, the yarn, the needle size, the needle distance or the tensile strain subject to which the yarn is placed on the needles being selected accordingly.

It is possible, for example, to include structures with large stitches or openings within the knitwear in areas in which airing is desired. In contrast, in areas in which support and stability are desired, fine-meshed stitch patterns, stiffer yarns or even multi-layered weft-knitting structures may be used, which will be described in the following. In the same manner, the thickness of the knitwear is variable.

Knitwear having more than one layer provides numerous possible constructions for the knitwear, which provide many advantages. Knitwear with more than one layer, e.g. two, may be weft-knitted or warp-knitted on a weft-knitting machine or a warp-knitting machine with several rows of needles, e.g. two, in a single stage, as described in the section "knitwear" above. Alternatively, several layers, e.g. two, may be weft-knitted or warp-knitted in separate stages and then placed above each other and connected to each other if applicable, e.g. by sewing, gluing, welding or linking.

Several layers fundamentally increase solidness and stability of the knitwear. In this regard, the resulting solidness depends on the extent to which and the techniques by which the layers are connected to each other. The same yarn or different yarns may be used for the individual layers. For example, it is possible in a weft-knitted fabric for one layer to be weft-knitted from multi-fiber yarn and one layer to be weft-knitted from monofilament, whose stitches are enmeshed. In particular, stretchability of the weft-knitted layer is reduced due to this combination of different yarns. In this construction, a layer made from monofilament may be arranged between two layers made from multi-fiber yarn in order to reduce stretchability and increase solidness of the knitwear. This results in a pleasant surface made from multi-fiber yarn on both sides of the knitwear.

An alternative of two-layered knitwear is referred to as spacer weft-knitted fabric or spacer warp-knitted fabric, as explained in the section "knitwear". In this regard, a spacer yarn is weft-knitted or warp-knitted more or less loosely between two weft-knitted or warp-knitted layers, interconnecting the two layers and simultaneously serving as a filler. The spacer yarn may comprise the same material as the layers themselves, e.g. polyester or another material. The spacer yarn may also be a monofilament which provides the spacer weft-knitted fabric or spacer warp-knitted fabric with stability.

Such spacer weft-knitted fabrics or spacer warp-knitted fabrics, respectively, which are also referred to as three-dimensional weft-knitted fabrics, which are differentiated from the formative 3D weft-knitted fabrics or 3D warp-knitted fabrics mentioned in the section "three-dimensional knitwear" above, may be used wherever additional cushioning or protection is desired, e.g. at the upper or the tongue of an upper or in certain areas of a sole. Three-dimensional structures may also serve to create spaces between neighboring textile layers or also between a textile layer and the foot and thus ensure airing. Moreover, the layers of a spacer weft-knitted fabric or a spacer warp-knitted fabric may comprise different yarns depending on the position of the spacer weft-knitted fabric on the foot.

The thickness of a spacer weft-knitted fabric or a spacer warp-knitted fabric may be set in different areas depending on the function or the wearer. Various degrees of cushioning may be achieved with areas of various thicknesses, for example. Thin areas may increase bendability, for example, thus fulfilling the function of joints or flex lines.

Moreover, the layers of a spacer weft-knitted fabric may comprise different yarns depending on the position of the spacer weft-knitted fabric on the foot. In this way, knitwear may be provided with two different colors for the front and the back, for example. An upper made from such knitwear may then comprise a different color on the outside than on the inside.

Other multi-layered constructions may include pockets or tunnels, in which two textile layers or knitwear weft-knitted or warp-knitted on two rows of needles are connected to each other only in certain areas so that a hollow space is created. Alternatively, items of knitwear weft-knitted or warp-knitted in two separate processes are connected to each other such that a void is created, e.g. by sewing, gluing, welding or linking. It is then possible to introduce a cushioning material such as a foam material, eTPU (expanded thermoplastic urethane), ePP (expanded polypropylene), expanded EVA (ethylene vinyl acetate) or particle foam, an air or gel cushion for example, through an opening, e.g. at the tongue, the upper, the heel, the sole or in other areas. Alternatively or additionally, the pocket may also be filled with a filler thread or a spacer knitwear. It is furthermore possible for threads to be pulled through tunnels, for example as reinforcement in case of tension loads in certain areas of an upper. Moreover, it is also possible for the laces to be guided through such tunnels. Moreover, loose threads may be placed into tunnels or pockets for padding, for example in the area of the ankle. However, it is also possible for stiffer reinforcing elements, such as caps, flaps or bones to be inserted into tunnels or pockets. These may be manufactured from plastic such as polyethylene, TPU, polyethylene or polypropylene, for example.

A further possibility for a functional design of knitwear is the use of certain variations of the basic weaves. In weft-knitting, it is possible for bulges, ribs or waves to be weft-knitted in certain areas, for example, in order to achieve reinforcement in these places. A wave may, for example, be created by stitch accumulation on a layer of knitwear. This means that more stitches are weft-knitted or warp-knitted on one layer than on another layer. Alternatively, different stitches are weft-knitted fabric on the one layer than on the other layer, e.g. by being weft-knitted fabric tighter, wider or using a different yarn. Thickening is caused in both alternatives.

Ribs, waves, or similar patterns may, for example, also be used at the bottom of a weft-knitted outer sole of a shoe in order to provide a tread and provide the shoe with better non-slip properties. In order to obtain a rather thick weft-knitted fabric, for example, it is possible to use the weft-knitting techniques "tuck" or "half cardigan", which are described in "Fachwissen Bekleidung", 6th ed. by H. Eberle et al., for example.

Waves may be weft-knitted or warp-knitted such that a connection is created between two layers of a two-layered knitwear or such that no connection is created between the two layers. A wave may also be weft-knitted as a right-left wave on both sides with or without a connection of the two layers. A structure in the knitwear may be achieved by an uneven ration of stitches on the front or the back of the knitwear.

A further possibility of functionally designing knitwear within the framework of the present invention is providing openings in the knitwear already during weft-knitting or warp-knitting. Embodiments in the course of the present invention, which may be combined with other embodiments, refer to an insole that comprises knitwear. The embodiments may also be applied to a strobel sole, however. The embodiments may equally be applied to an outer sole. An insole, strobel sole, or outer sole is generally arranged above a midsole. The midsole may comprise cushioning properties. The midsole may e.g. comprise a foam material. Other suitable materials are eTPU (expanded thermoplastic urethane), ePP (expanded polypropylene), expanded EVA (ethylene vinyl acetate) or particle foam, for example.

The knitwear of the insole, strobel sole, or outer sole comprises at least one opening which is weft-knitted or warp-knitted in already during weft-knitting or warp-knitting of the knitwear, respectively. The at least one opening enables the foot of a wearer of a shoe to be able to directly touch the midsole. This improves the cushioning properties of the shoe on the whole, so that the thickness of the midsole may be reduced.

In some embodiments, the at least one opening is arranged in the area of the calcaneus. An arrangement in this position has a particularly positive effect on the cushioning properties. A different position of the at least one opening is also possible.

In certain embodiments, functionally designing knitwear within the framework may include forming laces integrally with the knitwear of an upper. In these embodiments, the upper comprises knitwear and the laces are warp-knitted or weft-knitted as one piece with the knitwear already when the knitwear of the upper is weft-knitted or warp-knitted. In this regard, a first end of a lace is connected to the knitwear, while a second end is free.

In some embodiments, the first end is connected to the knitwear of the upper in the area of the transition from the tongue to the area of the forefoot of the upper. In these embodiments, a first end of a first lace may be connected to the knitwear of the upper at the medial side of the tongue and a first end of a second lace is connected to the knitwear of the upper at the lateral side of the tongue. The respective second ends of the two laces may then be pulled through lace eyelets for tying the shoe.

A possibility of speeding up the integral weft-knitting or warp-knitting of laces is having all yarns used for weft-knitting or warp-knitting knitwear end in the area of the transition from the tongue to the area of the forefoot of the upper. In some embodiments, the yarns may end in the medial side of the upper on the medial side of the tongue and form the lace connected on the medial side of the tongue. In certain embodiments, the yarns may end in the lateral side of the upper on the lateral side of the tongue and form the lace connected to the lateral side of the tongue. The yarns may then be cut off at a length that is sufficiently long for forming laces. The yarns may be twisted or intertwined, for example. The respective second end of the laces may be provided with a lace clip. Alternatively, the second ends are fused or provided with a coating.

The knitwear is particularly stretchable in the direction of the stitches (longitudinal direction) due to its construction. This stretching may be reduced e.g. by subsequent polymer coating of the knitwear. The stretching may also be reduced during manufacture of the knitwear itself. One possibility is reducing the mesh openings, that is, using a smaller needle size. Smaller stitches generally result in less stretching of the knitwear. Fine-meshed knitwear may e.g. be used at an upper (also referred to as shoe upper). Moreover, the stretching of the knitwear may be reduced by weft-knitted reinforcements, e.g. three-dimensional structures. Such structures may be arranged on the inside or the outside of an upper. Furthermore, non-stretchable yarn, e.g. made from nylon, may be laid in a tunnel along the knitwear in order to limit stretching to the length of the non-stretchable yarn.

Colored areas with several colors may be created by using a different thread and/or by additional layers. In transitional areas, smaller mesh openings (smaller needle sizes) are used in order to achieve a fluent passage of colors.

Further effects may be achieved by weft-knitted insets (inlaid works) or Jacquard knitting. Inlaid works are areas which only provide a certain yarn, e.g. in a certain color. Neighboring areas which may comprise a different yarn, for example in a different color, are then connected to each other by a so-called tuck stitch.

During Jacquard knitting, two rows of needles are used and two different yarns run through all areas, for example. However, in certain areas only one yarn appears on the visible side of the product and the respective other yarn runs invisibly on the other side of the product.

A product manufactured from knitwear may be manufactured in one piece on a weft-knitting machine or a warp-knitting machine. Functional areas may then already be manufactured during weft-knitting or warp-knitting by corresponding techniques as described here.

Alternatively, the product may be combined from several parts of knitwear and it may also comprise parts that are not manufactured from knitwear. In this regard, the parts of knitwear may each be designed separately with different functions, for example regarding thickness, isolation, transport of moisture, etc.

An upper and/or a sole may, for example, be generally manufactured from knitwear as a whole or it may be put together from different parts of knitwear. A whole upper or parts of that may, for example, be separated, e.g. punched, from a larger piece of knitwear. The larger piece of knitwear may, for example, be a circular weft-knitted fabric or a circular warp-knitted fabric or a flat weft-knitted fabric or a flat warp-knitted fabric.

For example, a tongue may be manufactured as a continuous piece and connected with the upper subsequently, or it may be manufactured in one piece with the upper. With regard to their functional designs, ridges on the inside may e.g. improve flexibility of the tongue and ensure that a distance is created between the tongue and the foot, which provides additional airing. Laces may be guided through one or several weft-knitted tunnels of the tongue. The tongue may also be reinforced with polymer in order to achieve stabilization of the tongue and e.g. prevent a very thin tongue from convolving. Moreover, the tongue may then also be fitted to the shape of the cobbler's last or the foot.

In an upper, it is possible for only the front part to be manufactured from knitwear, for example. The remainder of the upper may comprise a different textile and/or material, such as a woven fabric, for example. The front part may e.g. be located only in the area of the toes, extend beyond the toe joints or into the midfoot area. Alternatively, the back part of an upper may be manufactured from knitwear in the area of the heel, for example, and e.g. be additionally reinforced with polymer coating. In general, any desired areas of an upper or a sole may be manufactured as knitwear.

Applications such as polyurethane (PU) prints, thermoplastic polyurethane (TPU) ribbons, textile reinforcements, leather, etc., may be applied to knitwear subsequently. Thus, in an upper which comprises knitwear in its entirety or in parts, a plastic heel or toe cap as reinforcement or logos and eyelets for laces may be applied on the upper, for example by sewing, gluing or welding, as described below.

Sewing, gluing or welding, for example, constitute suitable connection techniques for connecting individual knitwear with other textiles or with other knitwear. Linking is another possibility for connecting two pieces of knitwear. Therein, two edges of knitwear are connected to each other according to the stitches (usually stitch by stitch).

A possibility for welding textiles, particularly ones made from plastic yarns or threads, is ultrasonic welding. Therein, mechanical oscillations in the ultrasonic frequency range are transferred to a tool referred to as a sonotrode. The oscillations are transferred to the textiles to be connected by the sonotrode under pressure. Due to the resulting friction, the textiles are heated up, softened and ultimately connected in the area of the place of contact with the sonotrode. Ultrasonic welding allows rapidly and cost-effectively connecting particularly textiles with plastic yarns or threads. It is possible for a ribbon to be attached, for example glued, to the weld seam, which additionally reinforces the weld seam and is optically more appealing. Moreover, wear comfort is increased since skin irritations—especially at the transition to the tongue—are avoided.

Figure 5A:
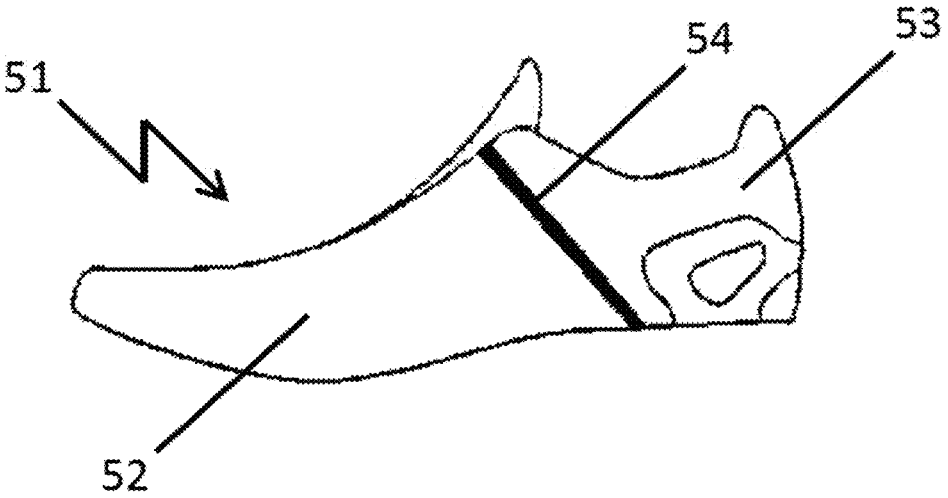
FIG. 5*a* is a side view of an upper with two connected textile areas, according to certain embodiments of the present invention.
Figure 5B:
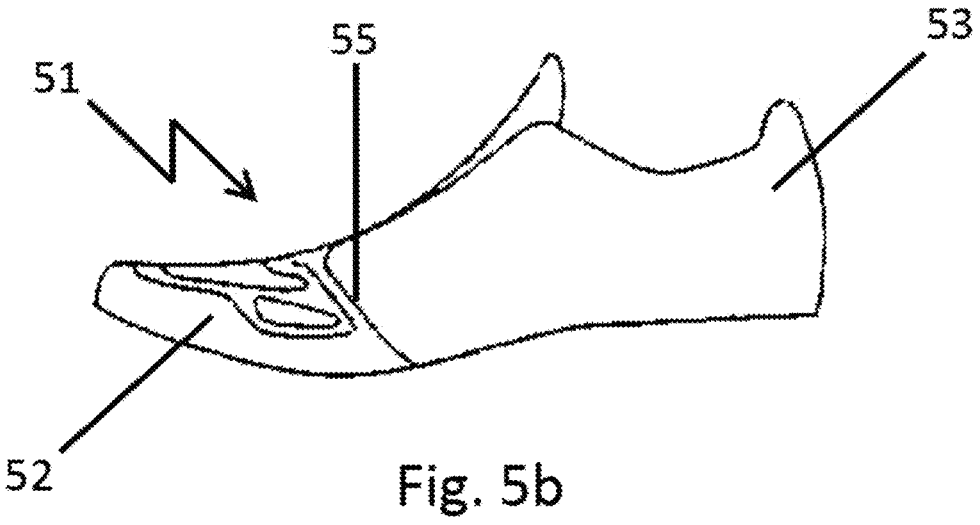
FIG. 5*b* is a side view of an upper with two connected textile areas, according to certain embodiments of the present invention.

Connecting various textile areas may occur at quite different locations. For example, the seams for connecting various textile areas of an upper may be arranged at various positions, as shown in FIGS. 5*a* and 5*b*. An upper 51 is shown in FIG. 5*a* which comprises two textile areas 52 and 53. They are sewn to each other. The seam 54 which connects the two textile areas 52 and 53 runs diagonally from an instep area of the upper to an area of the sole in the transition area from the midfoot to the heel. In FIG. 5*b* the seam 55 also runs diagonally, but it is arranged more to the front in the direction of the toes. Other arrangements of seams and connecting places in general are conceivable. The seams shown in FIGS. 5*a* and 5*b* may each be a thread seam, a glued seam, a welded seam or a linking seam. The two seams 54 and 55 may each be mounted only on one side of the upper 51 or on both sides of the upper.

In certain embodiments, adhesive tape may be used to connect textile areas. This feature may also be used in addition to an existing connection, e.g. over a sewn seam or a welded seam. An adhesive tape may fulfill further functions in addition to the function of connecting, such as e.g. protection against dirt or water. An adhesive tape may comprise properties which change over its length.

Figure 6A:
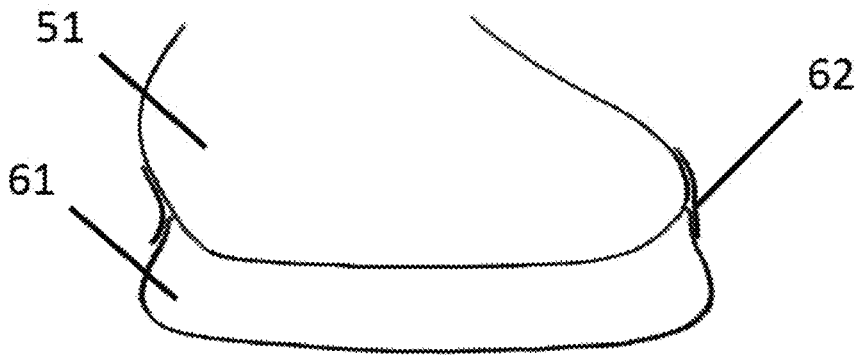
FIGS. 6*a*-6*c* are cross-sectional views of an upper connected to a shoe sole via adhesive tape, according to certain embodiments of the present invention.
Figure 6B:
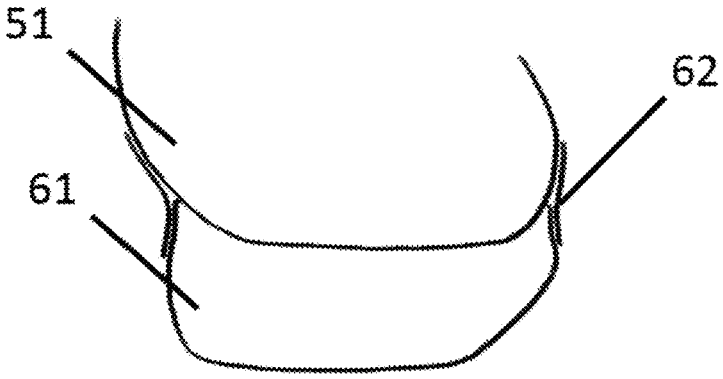
Figure 6C:
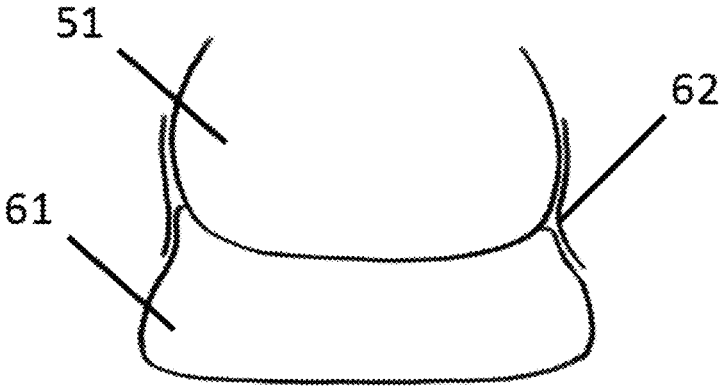

Embodiments of an upper 51 connected to a shoe sole 61 using adhesive tape are shown in FIGS. 6*a*, 6*b*, and 6*c*. Each of FIGS. 6*a*, 6*b*, and 6*c* shows a cross-section of a shoe depicting different positions of the foot and the resulting deformation of the shoe. For example, tensile forces work on the right side of the shoe in FIG. 6*a*, whereas compression forces work on the left side.

The shoe sole 61 may be an outer sole or a midsole. The upper 51 and the shoe sole 61 are connected to each other by a surrounding adhesive tape 62. The adhesive tape 62 may be of varying flexibility along its length. For example, the adhesive tape 62 might be particularly rigid and not very flexible in the shoe's heel area in order to provide the shoe with the necessary stability in the heel area. This may be achieved by varying the width and/or the thickness of the adhesive tape 62, for example. The adhesive tape 62 may generally be constructed such that it is able to receive certain forces in certain areas along the tape. In this way, the adhesive tape 62 does not only connect the upper to the sole but simultaneously fulfills the function of structural reinforcement.

Fibers

The yarns or threads, respectively, used for knitwear of the present invention usually comprise fibers. As was explained above, a flexible structure which is rather thin in relation to its length is referred to as a fiber. Very long fibers, of virtually unlimited length with regard to their use, are referred to as filaments. Fibers are spun or twisted into threads or yarns. Fibers may also be long, however, and twirled into a yarn. Fibers may include natural or synthetic materials. Natural fibers are environmentally friendly, since they are compostable. Natural fibers include cotton, wool, alpaca, hemp, coconut fibers or silk, for example. Among the synthetic fibers are polymer-based fibers such as nylon, polyester, elastane, or spandex, respectively, or Kevlar® or other para-aramid synthetic fiber, which may be produced as classic fibers or as high-performance fibers or technical fibers.

It is conceivable that a shoe be assembled from various parts, with a weft-knitted or a warp-knitted part comprising natural yarn made from natural fibers and a removable part, e.g. the insole, comprising plastic, for example. In this manner, both parts may be disposed of separately. In this example, the weft-knitted part could be directed to compostable waste, whereas the insole could be directed to recycling of reusable materials, for example.

Figure 7A:
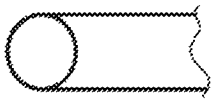
FIGS. 7*a*-7*o* are cross-sectional views of fibers for yarns used in knitwear, according to certain embodiments of the present invention.
Figure 7B:
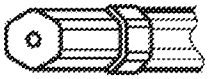
Figure 7C:
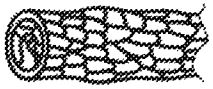
Figure 7D:
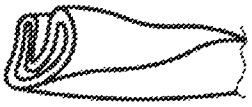
Figure 7E:
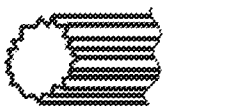
Figure 7F:
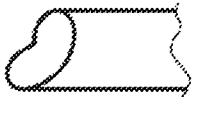
Figure 7G:
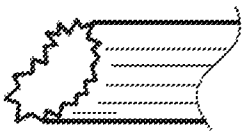
Figure 7H:
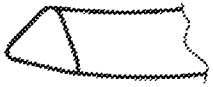
Figure 7I:
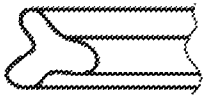
Figure 7J:
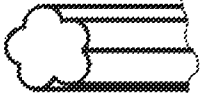
Figure 7K:
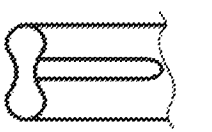
Figure 7L:
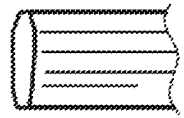
Figure 7M:
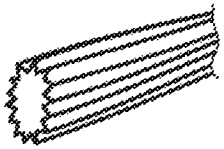
Figure 7N:
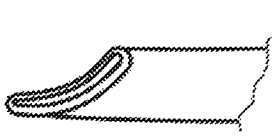
Figure 7O:
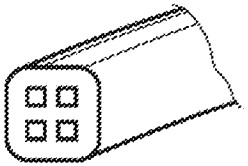

The mechanical and physical properties of a fiber and the yarn manufactured therefrom are also determined by the fiber's cross-section, as illustrated in FIGS. 7*a*-7*o*. These different cross-sections, their properties and examples of materials having such cross-sections will be explained in the following.

A fiber having the circular cross-section 710 may either be solid or hollow. A solid fiber is the most frequent type, it allows easy bending and is soft to the touch. A fiber as a hollow circle with the same weight/length ratio as the solid fiber has a larger cross-section and is more resistant to bending. Examples of fibers with a circular cross-section are nylon, polyester, and Lyocell.

A fiber having the bone-shaped cross-section 730 has the property of wicking moisture. Examples for materials for such fibers are acrylic and spandex. The concave areas in the middle of the fiber support moisture being passed on in the longitudinal direction, with moisture being rapidly wicked from a certain place and distributed.

The following further cross-sections are illustrated in FIGS. 7*a*-7*o:*

- polygonal cross-section 711 with nodes; example: flax;
- oval to round cross-section 712 with overlapping portions; example: wool;
- flat, oval cross-section 713 with expansion and convolution; example: cotton;
- circular, serrated cross-section 714 with partial striations; example: rayon;
- lima bean cross-section 720; smooth surface;
- serrated lima bean cross-section 721; example: Avril™ rayon;
- triangular cross-section 722 with rounded edges; example: silk;
- trilobal star cross-section 723; like triangular fiber with shinier appearance;
- clubbed cross-section 724 with partial striations; sparkling appearance; example: acetate;

flat and broad cross-section 731; example: acetate in another design;

star-shaped or concertina cross section 732;

cross-section 733 in the shape of a collapsed tube with a hollow center; and Square cross-section 734 with voids; example: AnsoIV™ nylon.

Individual fibers with their properties which are relevant for the manufacture of knitwear for the present invention will be described in the following:

aramid fibers: good resistance to abrasion and organic solvents; non-conductive; temperature-resistant up to 500° C.

para-aramid fibers: known under trade names Kevlar®, Techova™, and Twaron™; outstanding strength-to-weight properties; high Young's modulus and high tensile strength (higher than with meta-aramides); low stretching and low elongation at break (approx. 3.5%); difficult to dye.

meta-aramides: known under trade names Numex™, Teijinconex™, New Star™, X-Fiper™.

dyneema fibers: highest impact strength of any known thermoplastics; highly resistant to corrosive chemicals, with exception of oxidizing acids; extremely low moisture absorption; very low coefficient of friction, which is significantly lower than that of nylon and acetate and comparable to Teflon®; self-lubricating; highly resistant to abrasion (15 times more resistant to abrasion than carbon steel); nontoxic.

carbon fiber: an extremely thin fiber about 0.005-0.010 mm in diameter, composed substantially of carbon atoms; highly stable with regard to size; one yarn is formed from several thousand carbon fibers; high tensile strength; low weight; low thermal expansion; very strong when stretched or bent; thermal conductivity and electric conductivity.

glass fiber: high ratio of surface area to weight; by trapping air within them, blocks of glass fibers provide good thermal insulation; thermal conductivity of 0.05 W/(m×K); the thinnest fibers are the strongest because the thinner fibers are more ductile; the properties of the glass fibers are the same along the fiber and across its cross-section, since glass has an amorphous structure; correlation between bending diameter of the fiber and the fiber diameter; thermal, electrical and sound insulation; higher stretching before it breaks than carbon fibers.

Yarns

A plurality of different yarns may be used for the manufacture of knitwear according to certain embodiments in the present invention. As was already defined, a structure of one or several fibers which is long in relation to its diameter is referred to as a yarn.

Functional yarns are capable of transporting moisture and thus of absorbing sweat and moisture. They may be electrically conducting, self-cleaning, thermally regulating and insulating, flame resistant, and UV-absorbing, and may enable infrared radiation. They may be suitable for sensors. Antibacterial yarns, such as silver yarns, for example, prevent odor formation.

Stainless steel yarn contains fibers made of a blend of nylon or polyester and steel. Its properties include high abrasion resistance, high cut resistance, high thermal abrasion, high thermal and electrical conductivity, higher tensile strength and high weight.

In textiles made from knitwear, electrically conducting yarns may be used for the integration of electronic devices. These yarns may, for example, forward impulses from sensors to devices for processing the impulses, or the yarns may function as sensors themselves, and measure electric streams on the skin or physiological magnetic fields, for example. Examples for the use of textile-based electrodes may be found in European patent application EP 1 916 323.

Melt yarns may be a mixture of a thermoplastic yarn and a non-thermoplastic yarn. There are substantially three types of melt yarns: a thermoplastic yarn surrounded by a non-thermoplastic yarn; a non-thermoplastic yarn surrounded by thermoplastic yarn; and pure melt yarn of a thermoplastic material. After being heated to the melting temperature, thermoplastic yarn fuses with the non-thermoplastic yarn (e.g. polyester or nylon), stiffening the knitwear. The melting temperature of the thermoplastic yarn is determined accordingly and it is usually lower than that of the non-thermoplastic yarn in case of a mixed yarn.

A shrinking yarn is a dual-component yarn. The outer component is a shrinking material, which shrinks when a defined temperature is exceeded. The inner component is a non-shrinking yarn, such as polyester or nylon. Shrinking increases the stiffness of the textile material.

A further yarn for use in knitwear are luminescent or reflecting yarns and so-called "intelligent" yarns. Examples of intelligent yarns are yarns which react to humidity, heat or cold and alter their properties accordingly, e.g. contracting and thus making the stitches smaller or changing their volume and thus increasing permeability to air. Yarns made from piezo fibers or yarn coated with a piezo-electrical substance are able to convert kinetic energy or changes in pressure into electricity, which may provide energy to sensors, transmitters or accumulators, for example.

Yarns may furthermore generally be reworked, e.g. coated, in order to maintain certain properties, such as stretching, color or humidity resistance.

Polymer Coating

Due to its structure, weft-knitted or warp-knitted knitwear is considerably more flexible and stretchable than weaved textile materials. For certain applications and requirements, e.g. in certain areas of an upper or a sole according to the present invention, it is therefore necessary to reduce flexibility and stretchability in order to achieve sufficient stability.

For that purpose, a polymer layer may be applied to one side or both sides of knitwear (weft-knit or warp-knit goods), but generally also to other textile materials. Such a polymer layer causes a reinforcement and/or stiffening of the knitwear. In an upper it may e.g. serve the purpose of supporting and/or stiffening and/or reducing elasticity in the toe area, in the heel area, along the lace eyelets, on lateral and/or medial surfaces or in other areas. Furthermore, elasticity of the knitwear and particularly stretchability are reduced. Moreover, the polymer layer protects the knitwear against abrasion. Furthermore, it is possible to give the knitwear a three-dimensional shape using the polymer coating by compression-molding.

In the first step of polymer coating, the polymer material may applied to one side of the knitwear. It may also be applied on both sides, however. The material may be applied by spraying, knife coating, laying, printing, sintering, ironing or spreading. If it is polymer material in the form of a film, the latter is placed on the knitwear and connected with the knitwear by heat and pressure, for example. Spraying may be carried out by a tool similar to a hot glue gun. Spraying enables the polymer material to be applied evenly in thin layers. Moreover, spraying is a fast method. Effect pigments such as color pigments, for example, may be mixed into the polymer coating.

According to certain embodiments, the polymer is applied in at least one layer with a thickness of 0.2-1 mm. One or several layers may be applied, with it being possible for the layers to be of different thicknesses and/or colors. Between neighboring areas with polymer coating of various thicknesses there may be continuous transitions from areas with a thin polymer coating to areas with a thick polymer coating. In the same manner, different polymer materials may be used in different areas, as will be described in the following.

During application, polymer material attaches itself to the points of contact or points of intersection, respectively, of the yarns of the knitwear, on the one hand, and to the gaps between the yarns, on the other hand, forming a closed polymer surface on the knitwear after the processing steps described in the following. However, in case of larger mesh openings or holes in the textile structure, this closed polymer surface may also be intermittent, e.g. so as to enable airing. This also depends on the thickness of the applied material: The more thinly the polymer material is applied, the easier it is for the closed polymer surface to be intermittent. Moreover, the polymer material may also penetrate the yarn and soak it and thus contributes to its stiffening.

After application of the polymer material, the knitwear is pressed in a press under heat and pressure. The polymer material liquefies in this step and fuses with the yarn of the textile material.

In a further optional step, the knitwear may be pressed into a three-dimensional shape in a machine for compression-molding. For example, the area of the heel or the area of the toes of an upper may be shaped three-dimensionally over a cobbler's last. Alternatively, the knitwear may also be directly fitted to a foot.

After pressing and molding, the reaction time until complete stiffening may be one to two days, depending on the used polymer material.

The following polymer materials may be used: polyester; polyester-urethane pre-polymer; acrylate; acetate; reactive polyolefins; co-polyester; polyamide; co-polyamide; reactive systems (mainly polyurethane systems reactive with $H_2O$ or $O_2$); polyurethanes; thermoplastic polyurethanes; and polymeric dispersions.

A suitable range for viscosity of the polymer material is 50-80 Pa s (pascal second) at 90-150° C., which may further include a range of 15-50 Pa s (pascal second) at 110-150° C.

A suitable range for the hardness of the hardened polymer material is 40-60 Shore D. Depending on the application, other ranges of hardness are also conceivable.

The described polymer coating may be used sensibly wherever support functions, stiffening, increased abrasion resistance, elimination of stretchability, increase of comfort and/or fitting to prescribed three-dimensional geometries are desired. It is also conceivable to fit e.g. an upper to the individual shape of the foot of the person wearing it, by polymer material being applied to the upper and then adapting to the shape of the foot under heat.

Monofilaments for Reinforcement

As was already defined, a monofilament is a yarn formed by one single filament, that is, one single fiber. Therefore, in certain embodiments, stretchability of monofilaments is considerably lower than that of yarns which are manufactured from many fibers. This also reduces the stretchability of knitwear that is manufactured from monofilaments or include monofilaments and which are used in the present invention. Monofilaments are typically made from polyamide. However, other materials, such as polyester or a thermoplastic material, would also be conceivable.

So whereas knitwear made from a monofilament is considerably more rigid and less stretchable, this knitwear may not include the desired surface properties, such as e.g. smoothness, colors, transport of moisture, outer appearance and variety of textile structures as usual knitwear has. This disadvantage is overcome by the knitwear described in the following.

Figure 8:
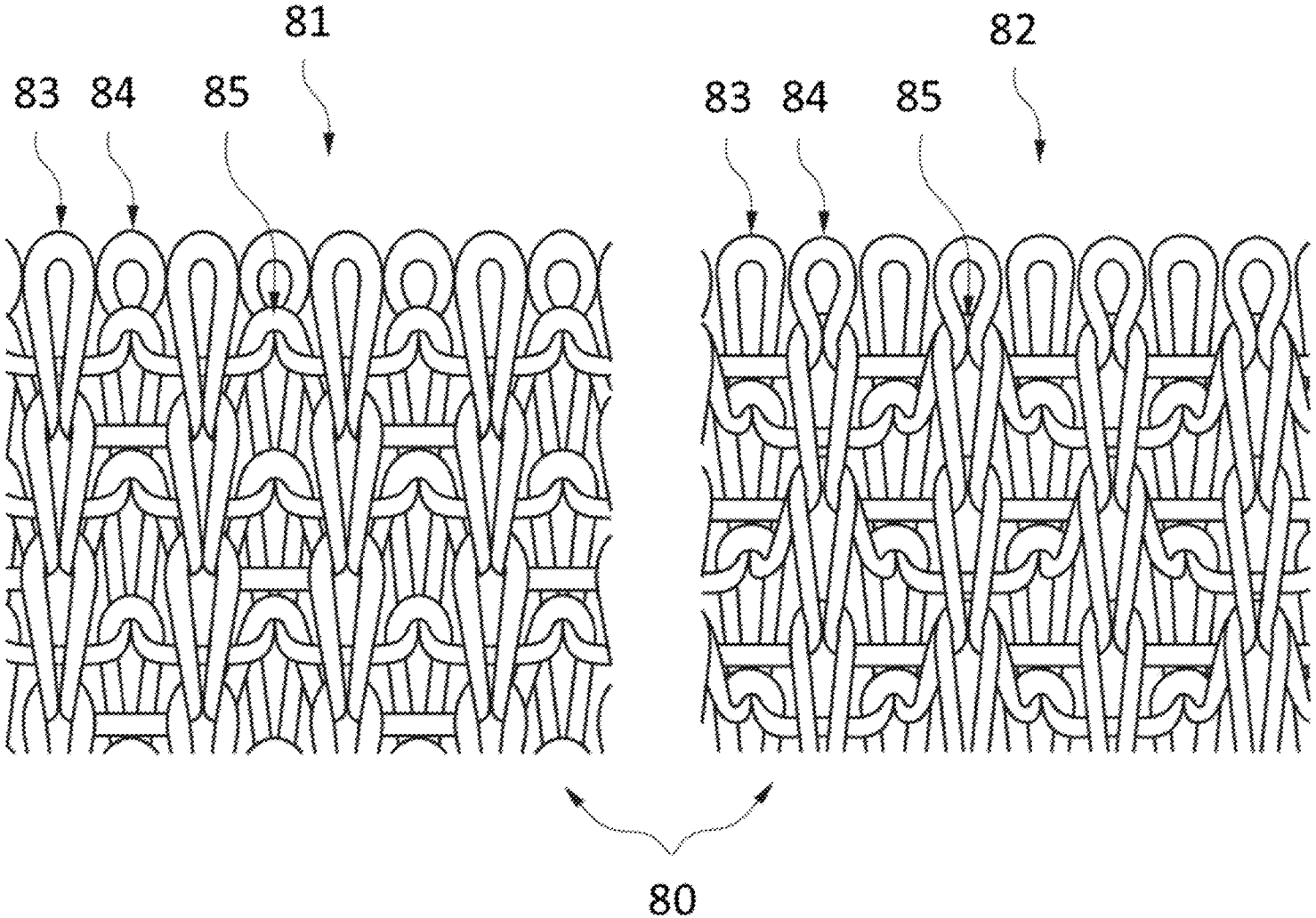
FIG. 8 is a front view and a back view of a knitwear, according to certain embodiments of the present invention.

FIG. 8 depicts a weft-knitted fabric having a weft-knitted layer made from a first yarn, such as a multi-fiber yarn, for example, and a weft-knitted layer made from monofilament. The layer of monofilament is weft-knitted into the layer of the first yarn. The resulting two-layered knitwear is considerably more solid and less stretchable than the layer made from yarn alone. If a monofilament melts slightly, the monofilament fuses with the first yarn even better.

FIG. 8 particularly depicts a front view 81 and a back view 82 of a two-layered knitwear 80. Both views show a first weft-knitted layer 83 made from a first yarn and a second weft-knitted layer 84 made from monofilament. The first weft-knitted layer 83 made from a first yarn is connected to the second weft-knitted layer 84 by stitches 85. Thus, the greater solidness and smaller stretchability of the second weft-knitted layer 84 made from the monofilament is transferred to the first weft-knitted layer 83 made from the first yarn.

A monofilament may also be melted slightly in order to connect with the layer of the first yarn and limit stretching even more. The monofilament then fuses with the first yarn at the points of contact and fixates the first yarn with respect to the layer made from monofilament.

Combination of Monofilaments and Polymer Coating

The weft-knitted fabric having two layers described in the preceding section may additionally be reinforced by a polymer coating as was already described in the section "polymer coating". The polymer material is applied to the weft-knitted layer made from monofilament. In doing so, it does not connect to the material (e.g. polyamide material) of the monofilament, since the monofilament has a very smooth and round surface, but substantially penetrates the underlying first layer of a first yarn (e.g. polyester yarn). During subsequent pressing, the polymer material therefore fuses with the yarn of the first layer and reinforces the first layer. In doing so, the polymer material has a lower melting point than the first yarn of the first layer and the monofilament of the second layer. The temperature during pressing is selected such that only the polymer material melts but not the monofilament or the first yarn.

Melt Yarn

For reinforcement and for the reduction of stretching, the yarn of the knitwear which is used according to the invention may additionally or alternatively also be a melt yarn that fixes the knitwear after pressing. There are substantially three types of melt yarns: a thermoplastic yarn surrounded by a non-thermoplastic yarn; a non-thermoplastic yarn surrounded by thermoplastic yarn; and pure melt yarn of a thermoplastic material. In order to improve the bond between thermoplastic yarn and the non-thermoplastic yarn, it is possible for the surface of the non-thermoplastic yarn to be texturized.

In certain embodiments, pressing takes place at a temperature ranging from 110 to 150° C., and may further be approximately 130° C. The thermoplastic yarn melts at least partially in the process and fuses with the non-thermoplastic yarn. After pressing, the knitwear is cooled, so that the bond is hardened and fixed. The melt yarn may be arranged in the upper and/or the sole.

In some embodiments, the melt yarn is weft-knitted into the knitwear. In case of several layers, the melt yarn may be weft-knitted into one, several or all layers of the knitwear.

In certain embodiments, the melt yarn may be arranged between two layers of knitwear. In doing so, the melt yarn may simply be placed between the layers. Arrangement between the layers has the advantage that the mold is not stained during pressing and molding, since there is no direct contact between the melt yarn and the mold.

Thermoplastic Textile for Reinforcement

A further possibility for reinforcing knitwear that is used for the present invention, for example in an upper and/or a sole, is the use of a thermoplastic textile. This is a thermoplastic woven fabric or thermoplastic knitwear. A thermoplastic textile melts at least partially when subjected to heat and stiffens as it cools down. A thermoplastic textile may, for example, be applied to the surface of an upper or a sole, which may comprise knitwear, for example, by applying pressure and heat. When it cools down, the thermoplastic textile stiffens and specifically reinforces the upper or the sole in the area in which it was placed, for example.

The thermoplastic textile may be specifically manufactured for the reinforcement in its shape, thickness and structure. Additionally, its properties may be varied in certain areas. The stitch structure, the knitting stitch, and/or the yarn used may be varied such that different properties are achieved in different areas.

According to certain embodiments, a thermoplastic textile is a weft-knitted fabric or warp-knitted fabric made from thermoplastic yarn. Additionally, the thermoplastic textile may also comprise a non-thermoplastic yarn. The thermoplastic textile may be applied to an upper or a sole of a shoe, for example, by pressure and heat.

A woven fabric whose wefts and/or warps are thermoplastic are other embodiments of a thermoplastic textile. Different yarns may be used in the weft direction and the warp direction of the thermoplastic woven fabric, so as to achieve different properties, such as stretchability, in the weft direction and the warp direction.

A spacer weft-knitted fabric or spacer warp-knitted fabric made from thermoplastic material are other embodiments of a thermoplastic textile. In this regard, e.g. only one layer may be thermoplastic, e.g. so as to be attached to an upper or a sole. Alternatively, both layers are thermoplastic, e.g. in order to connect the sole to the upper.

A thermoplastic weft-knitted fabric or warp-knitted fabric may be manufactured using the manufacturing techniques for knitwear described in the section "knitwear".

A thermoplastic textile may be connected with the surface to be reinforced only partially subject to pressure and heat so that only certain areas or only a certain area of the thermoplastic textile connects to the surface. Other areas or another area do not connect, so that the permeability for air and/or humidity is maintained there, for example. The function and/or the design of e.g. an upper or a sole may be modified by this.

Upper

Figure 9:
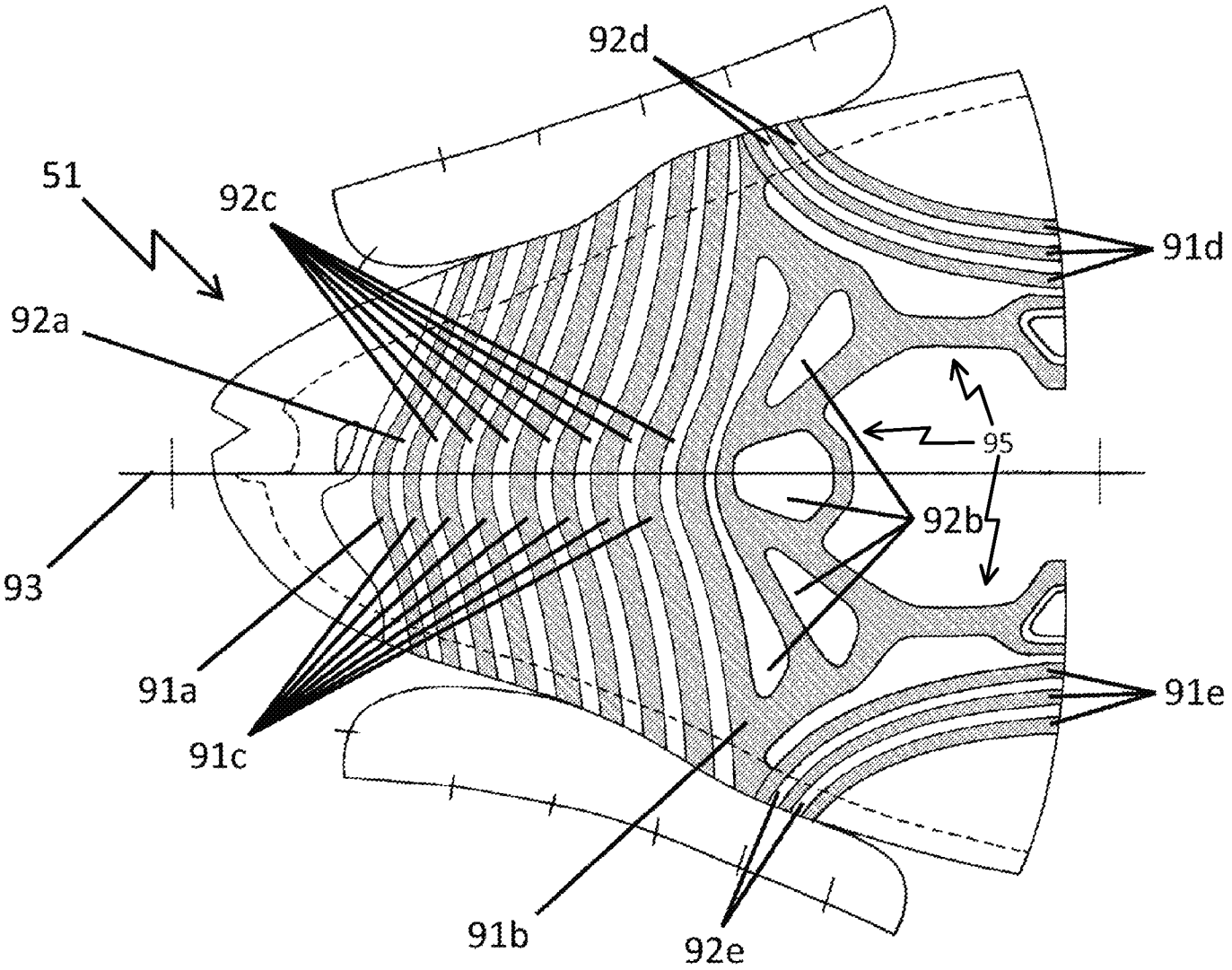
FIG. 9 is a front view of an upper, according to certain embodiments of the present invention.

FIG. 9 depicts an example of an upper 51, according to certain embodiments of the present invention. The upper 51 may be entirely or partially manufactured from knitwear. As described in the section "knitwear", knitwear may be manufactured on a weft-knitting machine or a warp-knitting machine. In addition to knitwear, the upper 51 may comprise other textiles, such as woven fabrics, for example, and non-textile elements, such as lace loops made from plastic, leather or metal, for example.

The upper 51 comprises a first partial area 91*a*, which is manufactured from knitwear made from a more elastic yarn. The first partial area 91*a* extends in the area of the forefoot in the flexing zone of the shoe and runs from the lateral side to the medial side via the upper side of the foot. The first partial area may generally also be arranged in other areas of the upper 51.

The shoe upper 51 comprises a second partial area 92*a*, which is manufactured as one-piece knitwear with a first partial area 91*a*. The first partial area 91*a* and the second partial area 92*a* may be manufactured in one piece on a weft-knitting machine or warp-knitting machine. The second partial area 92*a* runs substantially parallel to the first partial area 91*a* and directly neighbors this. Due to the substantially parallel course (the two partial areas are adjacent to one another), the contour of the second partial area 92*a* follows the contour of the first partial area 91*a*.

The first partial area 91*a* comprises a first yarn, while the second partial area 92*a* comprises a second yarn. The first yarn is more elastic than the second yarn. Elasticity, i.e. ductility, may be measured by a tensile strain being applied to the yarn and the resulting change in length being measured, for example. A yarn which stretches more, i.e. which undergoes a greater change in length than another yarn in case of defined tensile strain is more elastic than the latter. This measurement is usually carried out with sections of the same length of both yarns so as to keep changes in length comparable.

Elasticity, i.e. ductility of the yarn may be specified as Young's modulus, for example. Young's modulus is the quotient of the tensile strain and the resulting elongation, with the elongation specifying the ratio of the change in length to the original length. Young's modulus may be specified as Newton per square meter ($N/m^2$), for example. Thus, a more elastic yarn has a lower Young's modulus than a less elastic yarn.

The first yarn may comprise elastane or rubber. These two materials comprise great ductility. The second yarn may be a plastic yarn, such as nylon or polyester, but also a fuse/melt yarn, for example, which comprise lower ductility compared to elastane or rubber.

It is conceivable that the first partial area 91*a* and the second partial area 92*a* are not directly adjacent to each other. In this case, knitwear may be located between the first partial area 91*a* and the second partial area 92*a*, that is neither allocated to the first partial area 91*a* nor to the second partial area 92*a* (e.g. because it comprises neither the first yarn nor the second yarn) and which may be manufactured as one-piece knitwear with the first partial area 91*a* and the second partial area 92*a*.

In certain embodiments, as shown in FIG. 9, the first partial area 91*a* and the second partial area 92*a* are arranged approximately in the area of the metatarsophalangeal joints, i.e. the zone that flexes when the shoe is rolled over. These joints essentially serve the purpose of bending the toes. Due to this arrangement of the first partial area 91*a* and the second partial area 92*a*, the first partial area 91*a* undergoes greater stretching than the second partial area 92*a* during walking or running. Thus, the arrangement supports the movement of the feet.

The longitudinal axis 93 of the upper 51 is also shown in FIG. 9. In the proximity of the longitudinal axis 93, the first partial area 91*a* and the second partial area 92*a* run substantially orthogonal to the former, i.e. they cross the longitudinal axis 93 approximately at a right angle. Towards the lateral and medial side, the angle between the first partial area 91*a* and the longitudinal axis 93 changes. It deviates from the right angle. The same applies to the second partial area 92*a*. However, it is also conceivable that the first partial area 91*a* or the second partial area 92*a* or both partial areas 91*a* and 92*a* form an substantially right angle with the longitudinal axis 93 of the upper 51 along their entire respective lengths.

In certain embodiments, as shown in FIG. 9, the first partial area 91*a* and the second partial area 92*b* are furthermore arranged substantially symmetrically around the longitudinal axis 93 of the upper 51. The course of the first partial area 91*a* on the medial side corresponds to the course on the lateral side mirrored on the longitudinal axis 93 and vice versa. The same applies with regard to the course of the second partial area 92*a*. However, the courses of the first partial area 91*a* and the second partial area 92*a* do not have to be symmetrical.

A further first partial area 91*b* is shown in FIG. 9. This first partial area 91*b* is arranged in the ankle area (also referred to as collar area 95) of the upper 51. A second partial area 92*b* is arranged within the first partial area 91*b*. The first partial area 91*b* is manufactured as one-piece knitwear with the second partial area 92*b*. The first partial area 91*b* comprises a first yarn, while the second partial area 92*b* comprises a second yarn. According to embodiments of the invention, the first yarn is more elastic than the second yarn.

The second partial area 92*b* in the ankle region comprises four separate portions. Generally, the first partial area and the second partial area may comprise sections which may be connected or unconnected with each other, i.e. a partial area does not have to be a contiguous surface. A partial area may e.g. also be composed of two portions that are not adjacent to each other. If the portions are unconnected, the respective other partial area may be arranged between these portions, for example. In the embodiments shown in FIG. 9, the first partial area 91*b* is arranged between the portions of the second partial area 92*b*. It is also conceivable that knitwear is located between a portion of one partial area and a portion of the other partial area that is allocated neither to the first partial area nor to the second partial area (e.g. because it comprises neither the first yarn nor the second yarn) and which may be manufactured as one-piece knitwear with the first partial area and the second partial area.

Since the first partial area 91*b* is arranged in the ankle area in the embodiments of FIG. 9 and fully surrounds it, via its more elastic yarn, it supports the upper so that it fits the foot well and tightly surrounds the ankle area with even pressure without pressure sores occurring.

The first partial area 91*b* may additionally be padded in the ankle area, for example with a foam material or a spacer weft-knitted fabric, in order to achieve a comfortable wearing sensation. The first partial area 91*b* may also be manufactured as a spacer weft-knitted fabric or spacer warp-knitted fabric in the ankle area. In this manner, subsequent padding is omitted.

The second partial area may generally also be manufactured as a spacer weft-knitted fabric or spacer warp-knitted fabric. For example, the first partial area could assume the function of padding in this manner.

An example, shown in FIG. 9, depicts certain embodiments having a further first partial area 91*c* extending over the instep area of the upper 51. In certain embodiments, this partial area 91*c* includes seven unconnected portions. Parallel to the first partial area 91*c*, a second partial area 92*c* also extends over the bridge of the upper 51. In certain embodiments, the second partial area 92*c* also includes seven unconnected portions. However, a person of ordinary skill in the relevant art will understand that the partial area 91*c* and/or the second partial area 92*c* may have greater or fewer unconnected portions as needed or desired. The first partial area 91*c* is manufactured as one-piece knitwear with the second partial area 92*c*. The first partial area 91*c* comprises a first yarn, while the second partial area 92*c* comprises a second yarn. The first yarn is more elastic than the second yarn.

Due to the arrangement of the first partial area 91*c* with the more elastic yarn over the instep area, lacing may be done without, since the upper 51 comprises a certain ductility, which causes the upper 51 to adjust to the foot, in this area due to the second yarn. Simultaneously, however, the less elastic yarn in the second partial area 92*c* prevents the foot from shifting too much in case of movements with a high transmission of force from the foot to the ground (e.g. when suddenly slowing down when running). In other words, the first partial area 91*c* ensures a good fit of the upper 51 and a good fitting, while the second partial area 92*c* fixes the foot in case of great force transmissions and limits its maximum movement relative to the sole.

A first partial area 91*d* and a first partial area 91*e*, which are arranged in the heel area, are also shown in FIG. 9. A second partial area 92*d* or 92*e*, respectively, runs parallel to them. In this arrangement, partial areas 91*d*, 91*e*, 92*d* and 92*e* fulfill a similar function as partial areas 91*c* and 92*c*: On the one hand, the upper 51 adjusts to the foot in the heel area due to the ductility of the first partial area 91*c*, on the other hand, the second partial area 92*c* fixes the heel in case of high force transmissions, e.g. when speeding up from standing. Since more stability than elasticity is required in the heel area, the second partial area may e.g. be predominant in terms of surface area.

The first partial areas 91*a*, 91*b*, 91*c*, 91*d* and 91*e* as well as the second partial areas 92*a*, 92*c*, 92*d* and 92*e* in FIG. 9 extend to the sole area of the upper 51 (beyond the dashed line in FIG. 9) and are thus at least partially arranged in the sole area. It is also conceivable that the upper surrounds the foot e.g. in the midfoot area and that the first partial area runs under the sole. Mainly in the midfoot area, the first partial area may contribute to the midfoot being tightly surrounded due to the elasticity of the first yarn. In this example, the first partial area fulfills the function of a support of the arch of the foot.

Generally, the first partial area, such as first partial areas 91*a*, 91*b*, 91*c*, 91*d* and 91*e* in FIG. 9, may comprise a different mesh structure than the second partial area, such as second partial areas 92*a*, 92*b*, 92*c*, 92*d* and 92*e* in FIG. 9, for example. For example, the stitches of the first partial area may be tighter or comprise a different basic connection or interlace than the stitches in the second partial area.

On principle, the mesh structure may also differ within the first partial area or the second partial area. The type of weft-knitting or warp-knitting may also differ within the first partial area or the second partial area.

As reinforcement, the knitwear of the upper according to certain embodiments of the invention may generally comprise a monofilament, as described in the sections "monofilaments for reinforcement" and "combination of monofilaments and polymer coating". It is conceivable, for example, that the knitwear of the second partial area comprises a monofilament for reinforcement. The lower elasticity of the second partial area is then reinforced by the monofilament in addition to the lower ductility of the second yarn. The second partial area may also be reinforced as described in the sections "polymer coating", "combination of monofilaments and polymer coating" and "thermoplastic textile for reinforcement". This also applies with regard to the first partial area.

The knitwear of the upper according to certain embodiments of the invention may also comprise a melt yarn, as described in the sections "yarns" and "melting yarn". It may be heated beyond its melting temperature, fuses and stiffens when the knitwear is cooled down, thus reinforcing the latter. A melt yarn may be used in addition to the second yarn of the second partial area. However, use in the first partial area is not excluded.

In order to obtain a second partial area which differs from the first partial area with regard to the used yarn, weft-knitting or warp-knitting techniques which are known as such may be used. For example, the first partial area or the second partial area or both partial areas may be knit in intarsia or Jacquard technique.

It is also possible for the upper to substantially fully surround the foot of a person wearing it. In this case, the first partial area or the second partial area or both partial areas may be at least partially arranged in the area of the sole.

The upper 51 may be attached to a sole in order to obtain a shoe. For this purpose, the upper 51 may be glued, welded or sewn to the sole, as described in the section "functional knitted fabrics", for example. Alternatively, the sole may be manufactured in one piece with the upper, e.g. manufactured as one-piece knitwear on a weft-knitting or warp-knitting machine.

Figure 10:
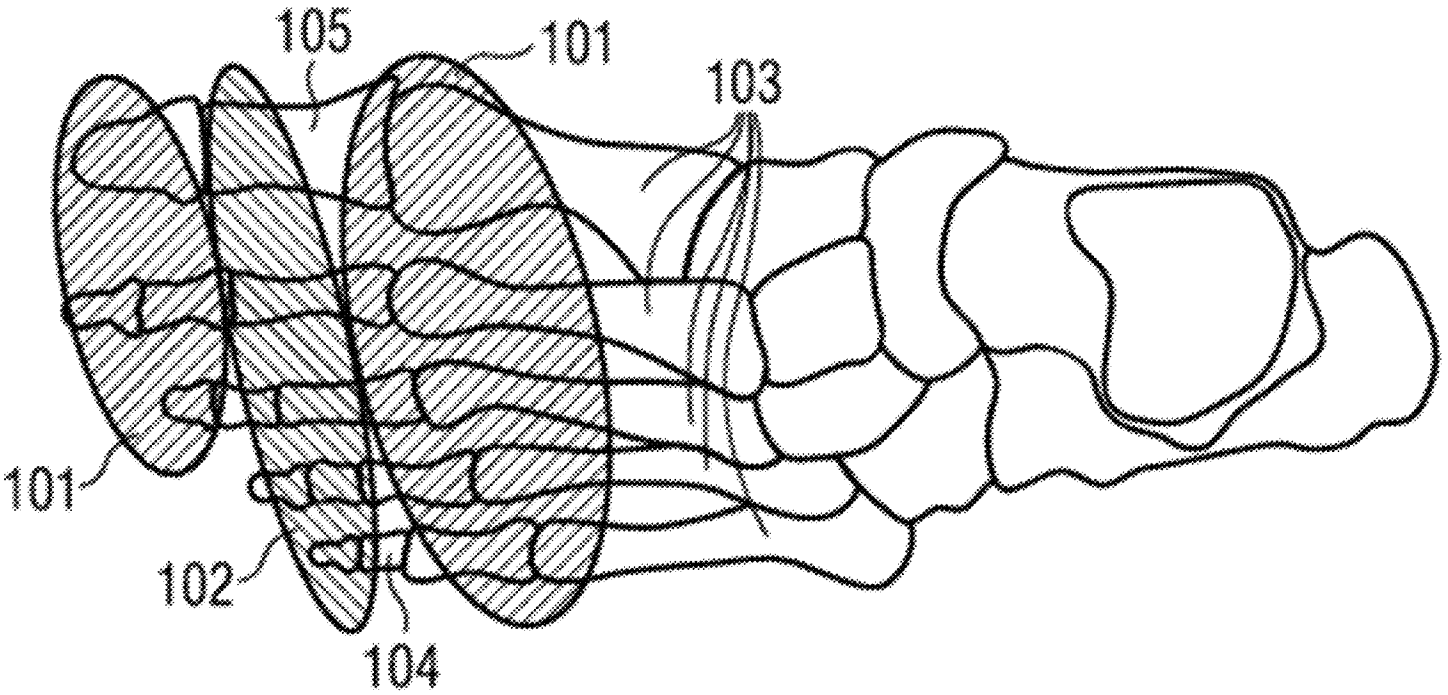
FIG. 10 is a top view of a foot skeleton illustrating the location of stretching that occurs at the foot during walking.

FIG. 10 shows zones 101 or 102 of the skeleton of a human foot, which require higher stability or higher flexibility, respectively. Thus, zone 102 between the proximal phalanx of the big toe 105 and the distal phalanx of the little toe 104 or between the midfoot and the toe joints in FIG. 10 requires increased flexibility of the shoe during the rolling-over movement of the toes when walking. In contrast, in the zone 101 of the toes and above the metatarsal bone 103, high flexibility is desirable.

In certain embodiments, therefore, the first partial area with the first, more elastic yarn is arranged in the area of the zone 102 in FIG. 10. In this regard, the first partial area may be arranged above the toes, on the top of the upper. However, it is also possible that the upper at least partially surrounds the foot in the area of zone 102 and that the first partial area is also arranged on the bottom side of the foot in the sole area.

So as to provide the foot with the necessary stability in the area of zones 101 and 103 in FIG. 10, the second partial area with the second, less elastic yarn may be arranged in the area of zones 101 and 103. In this regard, the second partial area may be arranged above the toes or the midfoot area, on the top of the upper. However, it is also possible that the upper at least partially surrounds the foot in the area of zones 101 and/or 102 and that the first partial area is also arranged on the bottom side of the foot in the sole area.

Figure 11A:
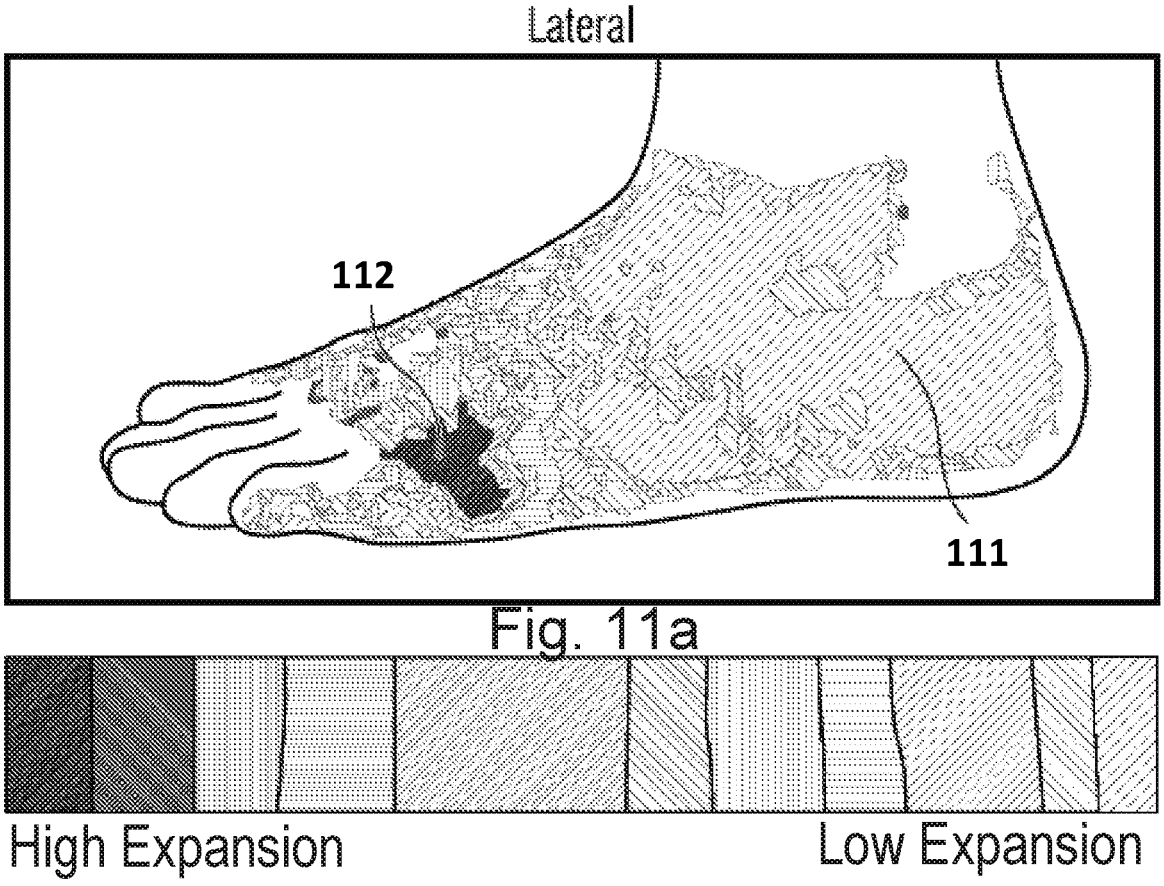
FIGS. 11*a*-11*b* are a lateral side view and a medial side view of a foot illustrating the location of stretching that occurs at the foot during walking, particularly laterally and medially.
Figure 11B:
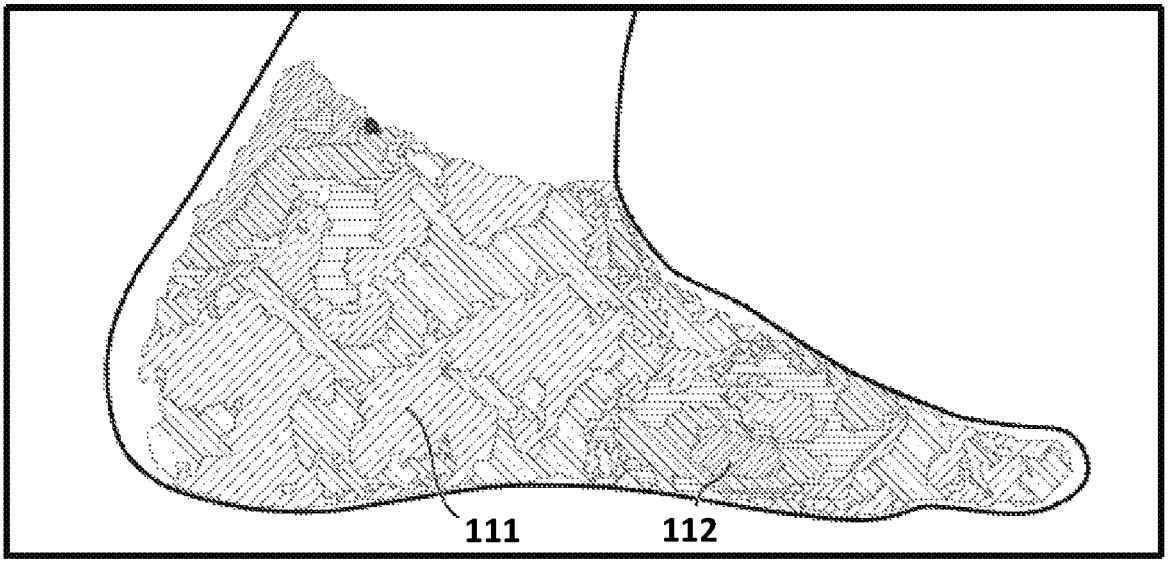

FIGS. 11*a*-11*b* show an example of a detailed analysis of the different zones of a foot. In this example, the local expansion of the foot at the surface of the foot, i.e. the skin, when walking barefoot illustrated graphically. It is apparent that increased expansions of the foot occurs when walking barefoot in the zone 112, i.e. in the rolling-over area 112 between the toe bones and the midfoot area, both medially and laterally. However, only slight extensions occur in the area of the ankle 111, for example.

According to certain embodiments of the present invention, the second partial area, which comprises the second, less elastic yarn, may be arranged where no great expansion of the surface, i.e. the skin of the foot is to be expected, e.g. in the area of the ankle 111. In these zones, greater flexibility and stability may be achieved in this manner, in order to stabilize the foot and thus prevent or reduce chafing or sliding of the foot in the show.

So as to be able to simultaneously provide a wearer of the shoe with a most pleasant walking feeling, however, the first partial area with the more elastic first yarn should be arranged in the zones in which greater expansions of the foot are to be expected. This is the case in zones 112 in FIGS. 11*a*-11*b*, for example.

Figure 12:
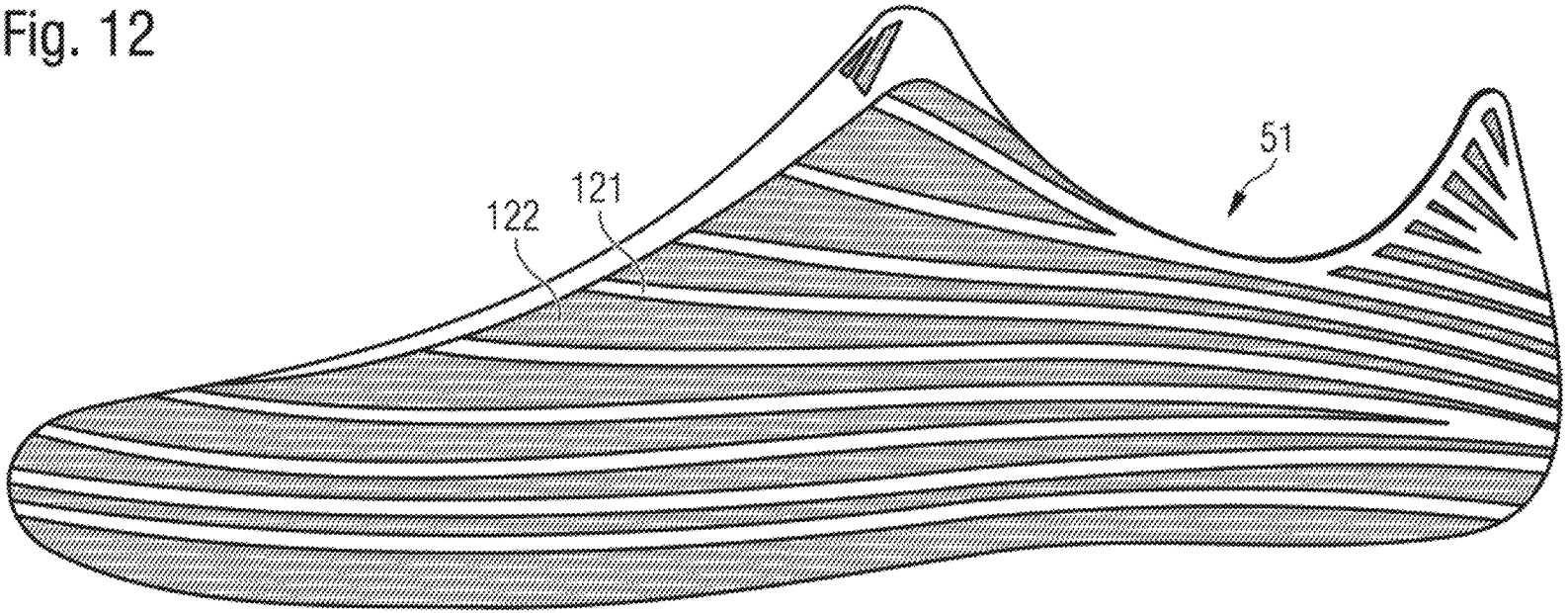
FIG. 12 is a side view of an upper, according to certain embodiments of the present invention.

FIG. 12 shows an upper 51, according to certain embodiments of the present invention, in which the first partial area and the second partial area run around the heel. By way of example, a first partial area is provided with reference number 121, whereas a second partial area is provided with reference number 122. The first partial area 121 and the second partial area 122 run above the instep like a ribbon, around the heel and on the inside of the foot (not shown in FIG. 12) back to the forefoot area. This arrangement of the first partial area 121 and the second partial area 122 enables kinetic energy to be temporarily stored in the form of potential energy and converted back into kinetic energy during the motion sequence. During walking, for example, the first partial area 121 is stretched, e.g. when the foot is shifted from the heel to the ball. The energy necessary for this is stored in the form of potential energy, similarly to a rubber. When the foot is pushed off via the ball, for example, this energy is converted into kinetic energy again and the first partial area 121 reverts to its original length. In this manner, the energy raised by the wearer of the shoe is better distributed over the entire motion sequence.

In the following, further examples are described to facilitate the understanding of the invention:

1. Upper (51) for a shoe, in particular a sports shoe, comprising:
   a. at least one first partial area (91*a*, 91*b*, 91*c*, 91*d*, 91*e*, 121) and at least one second partial area (92*a*, 92*b*, 92*c*, 92*d*, 92*e*, 122) which are manufactured as one-piece knitwear;
   b. wherein the first partial area (91*a*, 91*b*, 91*c*, 91*d*, 91*e*, 121) comprises a first yarn and the second partial area (92*a*, 92*b*, 92*c*, 92*d*, 92*e*, 122) comprises a second yarn; and
   c. wherein the first yarn is more elastic than the second yarn.
2. Upper (51) according to example 1, wherein the first partial area (91*a*, 91*b*, 91*c*, 91*d*, 91*e*, 121) and the second partial area (92*a*, 92*b*, 92*c*, 92*d*, 92*e*, 122) are arranged such that the first partial area (91*a*, 91*b*, 91*c*, 91*d*, 91*e*, 121) is stretched more than the second partial area (92*a*, 92*b*, 92*c*, 92*d*, 92*e*, 122) when the shoe is worn.
3. Upper (51) according to any one of the preceding examples, wherein the knitwear is weft-knitted.
4. Upper (51) according to any one of the preceding examples, wherein the knitwear is warp-knitted.
5. Upper (51) according to any one of the preceding examples, wherein the first partial area (91*a*, 91*b*, 91*c*, 91*d*, 91*e*, 121) and second partial area (92*a*, 92*b*, 92*c*, 92*d*, 92*e*, 122) run essentially parallel to one another.
6. Upper (51) according to any one of the preceding examples, wherein the first partial area (91*a*, 91*c*) and second partial area (92*a*, 92*c*) run essentially orthogonal to a longitudinal axis (93) of the shoe.
7. Upper (51) according to any one of the preceding examples, wherein the first partial area (91*a*, 91*c*, 121) and second partial area (92*a*, 92*c*, 122) are arranged on a lateral side or a medial side or on both sides of the midfoot area of the upper (51).

8. Upper (51) according to any one of the preceding examples, wherein the first partial area (91*b*, 91*c*) is arranged in the ankle area or in the instep area of the upper (51).

9. Upper (51) according to any one of the preceding examples, wherein the first partial area (91*a*, 91*b*, 91*c*, 91*d*, 91*e*) and the second partial area (92*a*, 92*b*, 92*c*, 92*d*, 92*e*) are arranged substantially symmetrically around a longitudinal axis (93) of the upper (51).

10. Upper (51) according to any one of the preceding examples, wherein the first yarn comprises elastane or rubber.

11. Upper (51) according to any one of the preceding examples, wherein the knitwear further comprises a monofilament.

12. Upper (51) according to any one of the preceding examples, wherein the knitwear further comprises a melt yarn.

13. Upper (51) according to any one of the preceding examples, wherein the first partial area (91*a*, 91*b*, 91*c*, 91*d*, 91*e*, 121) or the second partial area (92*a*, 92*b*, 92*c*, 92*d*, 92*e*, 122) or both partial areas (91*a*, 91*b*, 91*c*, 91*d*, 91*e*, 92*a*, 92*b*, 92*c*, 92*d*, 92*e*, 121, 122) are weft-knitted in intarsia or Jacquard technique.

14. Upper (51) according to any one of the preceding examples, wherein the upper (51) surrounds the foot of the wearer at least partially and wherein the first partial area (91*a*, 91*b*, 91*c*, 91*d*, 91*e*) or the second partial area (92*a*, 92*c*, 92*d*, 92*e*) or both partial areas are at least partially arranged in the area of the sole.

15. Shoe, in particular a sports shoe, comprising an upper (51) according to any one of the preceding claims.

16. Method of manufacturing an upper according to one of examples 1 to 14 with the step of manufacturing at least one partial area (91*a*, 91*b*, 91*c*, 91*d*, 91*e*, 121) and at least one second partial area (92*a*, 92*b*, 92*c*, 92*d*, 92*e*, 122) as one-piece knitwear, wherein the first partial area (91*a*, 91*b*, 91*c*, 91*d*, 91*e*, 121) comprises a first yarn and the second partial area (92*a*, 92*b*, 92*c*, 92*d*, 92*e*, 122) comprises a second yarn and wherein the first yarn is more elastic than the second yarn.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An upper for a shoe, comprising:

a first knitted textile forming a continuous section from a lateral side of the upper to a medial side of the upper, wherein the first knitted textile comprises a first yarn having elastic properties;

a second knitted textile arranged adjacent to the first knitted textile, wherein the arrangement of the second knitted textile follows a contour of the first knitted textile, wherein the second knitted textile comprises a monofilament, wherein the monofilament is less elastic than the first yarn, and wherein the first knitted textile undergoes greater stretching than the second knitted textile when a wearer of the shoe is walking or running; and a knitted fabric having an alternating pattern formed by at least two first knitted textiles separated by the second knitted textile, wherein the alternating pattern extends continuously from a lateral side to a medial side of a forefoot of the upper, and is arranged so that each of the first knitted textiles and the second knitted textile of the alternating pattern forms a curved pattern within the knitted fabric when the knitted fabric is laid flat with an apex of the curved pattern directed toward a toe region of the knitted fabric and positioned approximately along a longitudinal axis of the knitted fabric, wherein a width of each of the at least two first knitted textiles and the second knitted textile of the alternating pattern is consistent from the lateral side to the medial side of the forefoot of the knitted fabric, and wherein the knitted fabric is knitted in one piece to form the upper.

2. The upper of claim 1, wherein a knit structure of the second knitted textile reduces stretching of the second knitted textile.

3. The upper of claim 1, wherein a polymer coating is applied to the second knitted textile.

4. The upper of claim 1, wherein the at least two first knitted textiles of the alternating pattern are each wider than the second knitted textile of the alternating pattern.

5. The upper of claim 1, wherein the at least two first knitted textiles and the second knitted textile of the alternating pattern are arranged symmetrically around the longitudinal axis of the knitted fabric.

6. The upper of claim 1, wherein the alternating pattern extending continuously from the lateral side to the medial side of the forefoot of the upper is substantially U-shaped.

7. The upper of claim 1, wherein the alternating pattern is configured to be positioned in an area of the upper that is proximal to a distal phalanx of a great toe.

8. The upper of claim 7, wherein the alternating pattern is configured to extend from the area of the upper that is proximal to the distal phalanx of the great toe to a collar region of the upper.

9. An upper for a shoe, comprising:

a first knitted textile comprising a first yarn having elastic properties;

a second knitted textile arranged adjacent to the first knitted textile, wherein the arrangement of the second knitted textile follows a contour of the first knitted textile, wherein the second knitted textile comprises a monofilament, wherein the monofilament is less elastic than the first yarn, and wherein the first knitted textile undergoes greater stretching than the second knitted textile when a wearer of the shoe is walking or running; and a knitted fabric having a plurality of alternating patterns, each alternating pattern formed by at least two first knitted textiles separated by the second knitted textile, wherein a first alternating pattern extends continuously from a lateral side to a medial side of a forefoot of the upper and is arranged so that each of the first knitted textiles and the second knitted textile of the first alternating pattern forms a first curved pattern within the knitted fabric when the knitted fabric is laid flat with a first apex of the first curved pattern directed toward a toe portion of the knitted fabric and positioned approximately along a longitudinal axis of the knitted fabric, wherein a second alternating pattern is positioned in a heel region of the upper and forms a second curved pattern within the knitted fabric when the knitted fabric is laid flat with a second apex of the second curved pattern directed toward a collar region of the knitted fabric, and wherein the second alternating pattern extends between a lower edge of the knitted fabric to a midpoint of the heel region of the knitted fabric, wherein a width of each of the at least two first knitted textiles and the second knitted textile of the first alternating pattern is consistent from the lateral side to the medial side of the forefoot of the upper, and wherein the knitted fabric is knitted in one piece to form the upper.

10. The upper of claim 9, wherein the first alternating pattern is configured to be positioned in an area of the upper that is proximal to a distal phalanx of a great toe.

11. The upper of claim 9, wherein the first alternating pattern extends continuously from a lateral side to a medial side of a midfoot of the upper.

12. The upper of claim 9, wherein the collar region of the knitted fabric comprises at least one first knitted textile and at least two second knitted textiles, wherein the at least one first knitted textile encircles an ankle of the wearer of the shoe when the shoe is worn and the at least two second knitted textiles are positioned within the at least one first knitted textile.

13. The upper of claim 12, wherein the at least two second knitted textiles of the collar region of the knitted fabric are positioned within the at least one first knitted textile of the collar region of the knitted fabric symmetrically around the longitudinal axis of the knitted fabric.

14. An upper for a shoe, comprising:

a first knitted textile comprising a first yarn having elastic properties;

a second knitted textile arranged adjacent to the first knitted textile, wherein the arrangement of the second knitted textile follows a contour of the first knitted textile, wherein the second knitted textile comprises a monofilament, wherein the monofilament is less elastic than the first yarn, and wherein the first knitted textile undergoes greater stretching than the second knitted textile when a wearer of the shoe is walking or running; and a knitted fabric having an alternating pattern formed by at least two first knitted textiles separated by the second knitted textile, wherein the alternating pattern is positioned in a heel region of the upper and forms a curved pattern within the knitted fabric when the knitted fabric is laid flat with an apex of the curved pattern directed toward a collar region of the knitted fabric, and wherein the alternating pattern extends between a lower edge of the knitted fabric to a midpoint of the heel region of the knitted fabric, wherein a width of each of the at least two first knitted textiles and the second knitted textile of the alternating pattern is consistent from the lower edge of the knitted fabric to a midpoint of the heel region of the knitted fabric, and wherein the knitted fabric is knitted in one piece to form the upper.

15. The upper of claim 14, wherein the knitted fabric has a second alternating pattern formed by at least two first knitted textiles separated by the second knitted textile, the second alternating pattern extending continuously from a lateral side to a medial side of the upper and running essentially orthogonal to a longitudinal axis of the upper.

16. The upper of claim 14, wherein a knit structure of the second knitted textile reduces stretching of the second knitted textile.

17. The upper of claim 14, wherein the knitted fabric is at least one of weft-knitted or warp-knitted.

18. The upper of claim 14, wherein the first yarn comprises elastane or rubber.

19. The upper of claim 14, wherein the knitted fabric includes a melt yarn, wherein the melt yarn provides stiffening in areas of the knitted fabric that include the melt yarn.

20. The upper of claim 14, wherein the collar region of the knitted fabric comprises at least one first knitted textile and at least two second knitted textiles, wherein the at least one first knitted textile encircles an ankle of the wearer of the shoe when the shoe is worn and the at least two second knitted textiles are positioned within the at least one first knitted textile.

* * * * *